US010018940B2

(12) United States Patent
Eto

(10) Patent No.: US 10,018,940 B2
(45) Date of Patent: Jul. 10, 2018

(54) DEVELOPER STORAGE CONTAINER AND IMAGE FORMING APPARATUS EQUIPPED THEREWITH

(71) Applicant: KYOCERA Document Solutions Inc., Osaka-shi (JP)

(72) Inventor: Daisuke Eto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/678,159

(22) Filed: Aug. 16, 2017

(65) Prior Publication Data

US 2018/0052407 A1 Feb. 22, 2018

(30) Foreign Application Priority Data

Aug. 19, 2016 (JP) ..... 2016-160956

(51) Int. Cl.
*G03G 15/08* (2006.01)

(52) U.S. Cl.
CPC . *G03G 15/0886* (2013.01); *G03G 2215/0692* (2013.01)

(58) Field of Classification Search
CPC ..... G03G 15/0886; G03G 15/0877; G03G 21/1676; G03G 2215/0692; G03G 2221/163
See application file for complete search history.

(56) References Cited

U.S. PATENT DOCUMENTS

2006/0013621 A1 1/2006 Kimura et al.
2008/0025764 A1 1/2008 Kimura et al.
2008/0181661 A1* 7/2008 Mase ..... G03G 15/0886 399/120
2008/0199224 A1* 8/2008 Isomura ..... G03G 15/0886 399/258
2009/0290911 A1 11/2009 Kimura et al.
2010/0247159 A1* 9/2010 Imai ..... G03G 15/0886 399/260
2011/0052269 A1 3/2011 Kimura et al.
(Continued)

FOREIGN PATENT DOCUMENTS

JP 2004-258472 9/2004
JP 2006-30569 2/2006

*Primary Examiner* — Sophia S Chen
(74) *Attorney, Agent, or Firm* — Gerald E. Hespos; Michael J. Porco; Matthew T. Hespos

(57) ABSTRACT

Disclosed is a developer storage container including a container body and a shutter. The container body has a developer discharge port and is capable of being changed in posture. The shutter is configured to sealingly close or open the developer discharge port, and includes a shutter body, a swingable member and a shaft displacement restriction portion. The shutter body has a sealing surface for sealingly closing the developer discharge port, and a pair of bearing portions. The swingable member has a pair of shaft portions each pivotally supported by a respective one of the pair of bearing portions. The swingable member is swingable between a restriction position where it restricts a sliding movement of the shutter, and a permission position where it permits the sliding movement of the shutter. The shaft displacement restriction portion is configured to restrict an axial movement of the pair of shaft portions.

5 Claims, 28 Drawing Sheets

(56) References Cited

U.S. PATENT DOCUMENTS

| | | | |
|---|---|---|---|
| 2012/0076550 | A1 | 3/2012 | Kimura et al. |
| 2013/0259535 | A1 | 10/2013 | Kimura et al. |
| 2014/0227009 | A1 | 8/2014 | Kimura et al. |
| 2015/0168872 | A1 | 6/2015 | Kimura et al. |
| 2016/0154340 | A1 | 6/2016 | Kimura et al. |
| 2016/0378022 | A1 | 12/2016 | Kimura et al. |

* cited by examiner

DEVELOPER STORAGE CONTAINER AND IMAGE FORMING APPARATUS EQUIPPED THEREWITH

INCORPORATION BY REFERENCE

This application is based on Japanese Patent Application Serial No. 2016-160956 filed in Japan Patent Office on Aug. 19, 2016, the contents of which are hereby incorporated by reference.

BACKGROUND

The present disclosure relates to a developer storage container for storing developer thereinside, and image forming apparatus equipped with the developer storage container.

Conventionally, in an electrophotographic image forming apparatus, development processing is performed by supplying developer from a development device to an electrostatic latent image formed on a surface of a photosensitive drum which is an image carrier. Developer for use in such development processing is supplementarily supplied from a developer storage container to the development device.

A conventional developer storage container (toner cartridge) includes a development discharge port for discharging developer toward the development device therethrough, and a shutter operable to sealingly close or open the development discharge port. This shutter is configured such that it is slidingly moved to open the development discharge port, when the developer storage container is inserted in one direction and mounted to a device body of the development device.

SUMMARY

According to a first aspect of the present disclosure, there is provided a developer storage container demountably mounted to a development device. The developer storage container includes a container body and a shutter.

The container body stores developer thereinside and has a developer discharge port for discharging the developer toward the development device therethrough, wherein the container body is capable of being changed in posture between a first posture to be mounted to the development device, and a second posture to be rotated from the first posture in given one direction. The shutter is supported by the container body in such a manner as to be slidingly movable with respect to the developer discharge port in response to the postural change to thereby sealingly close or open the developer discharge port.

The shutter includes a shutter body, a swingable member, and a shaft displacement restriction portion. The shutter body has a sealing surface for sealingly closing the developer discharge port, and a pair of bearing portions provided on a back surface thereof on a side opposite to the sealing surface. The swingable member has a pair of shaft portions each pivotally supported by a respective one of the pair of bearing portions, wherein the swingable member is mounted to the back surface of the shutter body in such a manner as to be swingable about the shaft portions and between a sliding movement restriction position where the swingable member restricts the sliding movement of the shutter, and a sliding movement permission position where the swingable member permits the sliding movement of the shutter. The shaft displacement restriction portion restricts an axial movement of the pair of shaft portions of the swingable member.

According to a second aspect of the present disclosure, there is provided an image forming apparatus including: an image carrier having a surface on which an electrostatic latent image is to be formed and a developer image is to be carried; a development device which supplies developer to the image carrier; and the developer storage container according to the first aspect of the present disclosure, wherein the developer storage container is mounted to the development device so as to supplementarily supply developer to the development device.

DETAILED DESCRIPTION

A developer storage container and an image forming apparatus according to one embodiment will now be described based on the drawings.

<Structure of Image Forming Apparatus>

Figure 1:
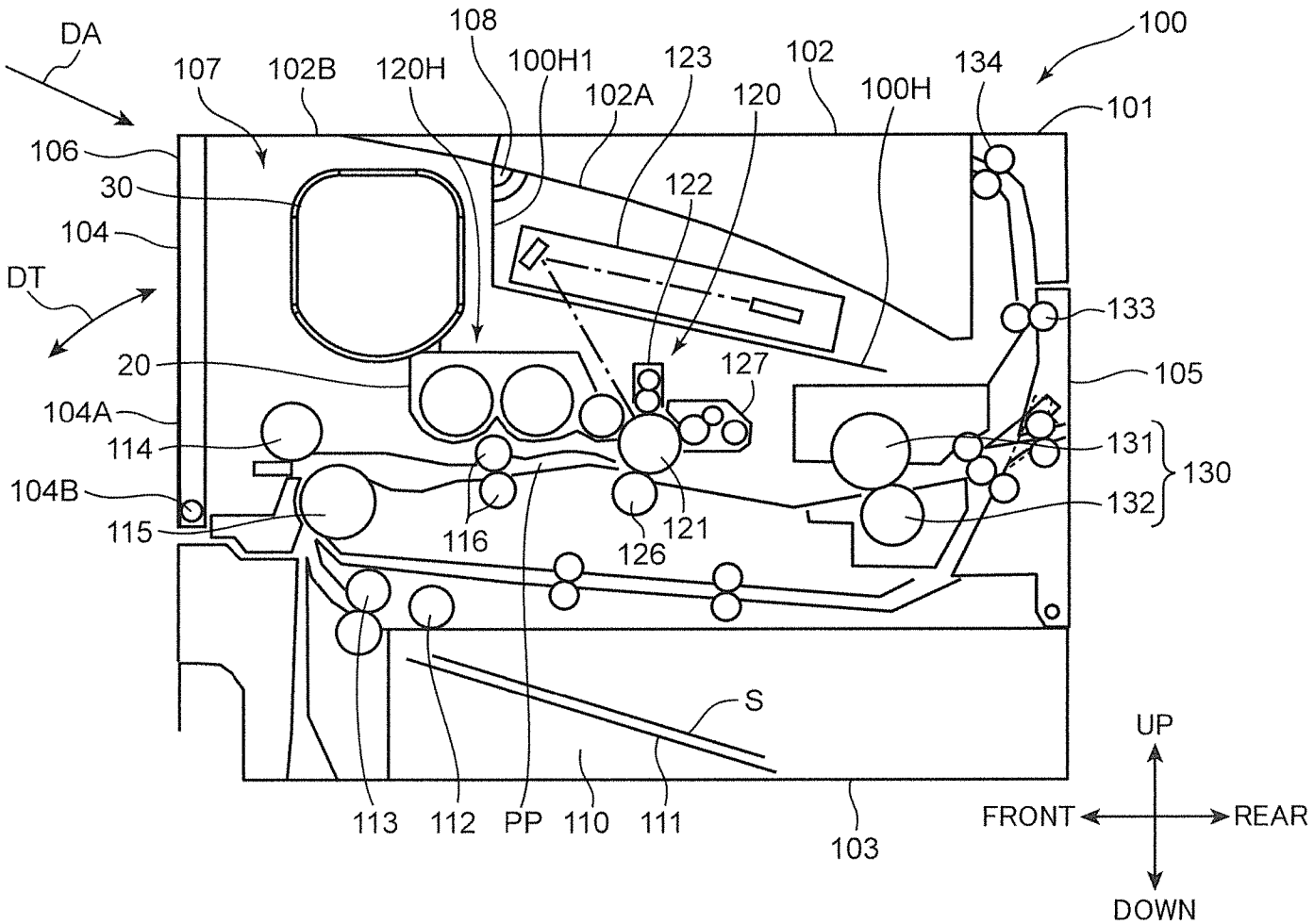
FIG. 1 is a schematic diagram depicting an internal structure of an image forming apparatus according to one embodiment of the present disclosure.

FIG. 1 is a schematic diagram depicting an internal structure of an image forming apparatus 100 according to one embodiment of the present disclosure. The image forming apparatus 100 depicted in FIG. 1 is an electrophotographic, so-called monochrome printer. However, in another embodiment, the image forming apparatus may be a color printer, a facsimile machine, a complex machine having functions thereof, or any other type of apparatus for forming a toner image on a sheet. Further, the term used in the following description to express a direction, such as "up (upward)", "down (downward)", "front (forward)", "rear (rearward)", "left (leftward)" or "right (rightward)", is merely intended to make descriptions clear, but not meant to limit the structure of the image forming apparatus.

The image forming apparatus 100 includes an apparatus body 101 which houses various devices for forming an image on a sheet S. The apparatus body 101 includes: an upper wall 102 defining an upper surface of the apparatus body 101; a bottom wall 103 defining a bottom surface of the apparatus body 101; a rear wall 105 provided between the upper wall 102 and the bottom wall 103 to extend in an upward-downward direction; and a front wall 104 located forward of the rear wall 105. The apparatus body 101 defines an internal space 107 in which various devices are arranged. In the internal space 107 of the apparatus body 101, a sheet conveyance path PP is provided as a means to convey a sheet S in a sheet conveyance direction.

A central region of the upper wall 102 is formed as a sheet catch section 102A. The sheet catch section 102A is formed to have an inclined surface extending rearwardly and obliquely downwardly from a front portion of the upper wall 102. The sheet catch section 102A is disposed to allow a sheet S having an image formed thereon by an aftermentioned image forming section 120 to be ejected thereinto. The front wall 104 is provided with a front cover 106 and a manual feed tray 104A. Each of the front cover 106 and the manual feed tray 104A is capable of being opened downwardly and closed upwardly about a pivot point at a lower end thereof (see the arrowed line DT in FIG. 1). The manual feed tray 104A is configured to be swingable with respect to the front cover 106. The manual feed tray 104A has a pivot portion 104B serving as the above pivot point. The front cover 106 and the manual feed tray 104A makes up a portion of the front wall 104 when it is in a closed state with respect to the apparatus body 101.

On the other hand, the upper wall 102 is configured such that a front end portion 102B thereof is swingingly movable rearwardly about an arm 108 serving as a pivot point. When the front end portion 102B of the upper wall 102 and the front cover 106 are opened, the internal space 107 of the apparatus body 101 is exposed to an outside of the image forming apparatus 100. This allows a user to mount an aftermentioned development unit 120H and toner container 30 inside the apparatus body 101. Further, when a sheet S is jammed in the sheet conveyance path PP, a user can remove the sheet S through the exposed area.

The image forming apparatus 100 further includes a cassette 110, a pickup roller 112, a first sheet feeding roller 113, a second sheet feeding roller 114, a conveyance roller 115, a registration roller pair 116, an image forming section 120, and a fixing device 130.

The cassette 110 accommodates therein a plurality of sheets S. The cassette 110 is provided with a lift plate 111. The lift plate 111 is inclined to push up leading edges of the sheets S. The cassette 110 is configured to be drawable forwardly with respect to the apparatus body 101.

The pickup roller 112 is disposed just above the leading edge of an uppermost one of the sheets S pushed up by the lift plate 111. Upon rotation of the pickup roller 112, the uppermost sheet S is picked up from the cassette 110. The first sheet feeding roller 113 is disposed downstream of the pickup roller 112, and is operable to feed out the sheet S toward a downstream side. The second sheet feeding roller 114 is disposed inward (rearward) of the pivot point of the manual feed tray 104A, and is operable to pull a sheet S on the manual feed tray 104A inside the apparatus body 101.

The conveyance roller 115 is disposed downstream of the first sheet feeding roller 113 and the second sheet feeding roller 114 in the sheet conveyance direction, and is operable to further convey the sheet S toward the downstream side. The registration roller pair 116 has a function of correcting oblique conveyance of the sheet S. Through this correction, a position of an image to be formed on the sheet S is adjusted. The registration roller pair 116 is operable to feed the sheet S to the image forming section 120 in conformity to a timing of image formation by the image forming section 120.

The image forming section 120 includes a photosensitive drum 121 (image carrier), an electrostatic charger 122, an exposure device 123, a development device 20, a toner container 30 (developer storage container), a transfer roller 126, and a cleaning device 127. The development device 20 and the toner container 30 are configured to be integrally mountable and demountable with respect to the apparatus body 101, in the form of a development unit 120H.

The photosensitive drum 121 has a cylindrical shape. The photosensitive drum 121 has a surface on which an electrostatic latent image is to be formed and a toner image (developer image) corresponding to the electrostatic latent image is to be carried. The electrostatic charger 122 is operable, upon application of a given voltage thereto, to electrostatically charge the surface of the photosensitive drum 121 approximately uniformly.

The exposure device 123 is operable to emit a laser beam to the surface of the photosensitive drum 121 electrostatically charged by the electrostatic charger 122. The laser beam is emitted according to image data output from an external device (not depicted) such as a personal computer communicatably connected to the image forming apparatus 100. As a result, an electrostatic latent image corresponding to the image data is formed on the surface of the photosensitive drum 121. As depicted in FIG. 1, the exposure device 123 is supported by a support frame 100H. The support frame 100H is disposed inside the apparatus body 101. More specifically, the support frame 100H is disposed along the sheet catch section 102A extending rearwardly and obliquely downwardly. The support frame 100H has a front end formed as a front wall 100H1 standing upwardly. More specifically, the front wall 100H1 of the support frame 100H is formed to extend vertically at a position just below the sheet catch section 102A. The front wall 100H1 of the support frame 100H is disposed in opposed relation to the toner container 30.

The development device 20 is operable to supply toner (developer) to the surface of the photosensitive drum 121 having an electrostatic latent image formed thereon. The toner container 30 is configured to store toner thereinside and supplementarily supply the toner to the development device 20. The toner container 30 is demountably mounted to the development device 20. When toner is supplied from the development device 20 to the photosensitive drum 121, an electrostatic latent image formed on the surface of the photosensitive drum 121 is developed (visualized). As a result, a toner image (developer image) is formed on the surface of the photosensitive drum 121.

The transfer roller 126 is disposed below and in opposed relation to the photosensitive drum 121 across the sheet conveyance path PP. The transfer roller 126 forms a transfer nip zone in cooperation with the photosensitive drum 121, so that it is possible to transfer a toner image onto the sheet S during passing through the transfer nip zone. The cleaning device 127 is operable to remove toner remaining on the surface of the photosensitive drum 121 after the toner image is transferred to the sheet S.

The fixing device 130 is disposed downstream of the image forming section 120 in the sheet conveyance direction, and is operable to fix the toner image on the sheet S. The fixing device 130 includes a heating roller 131 for melting toner on the sheet S, and a pressure roller 132 for bringing the sheet S into close contact with the heating roller 131.

The image forming apparatus 100 further includes a conveyance roller pair 133 disposed downstream of the fixing device 130, and an ejection roller pair 134 disposed downstream of the conveyance roller pair 133. The sheet S after being subjected to fixing by the fixing device 130 is conveyed upwardly via the conveyance roller pair 133, and finally ejected from the apparatus body 101 via the ejection roller pair 134. The sheets S sequentially ejected from the apparatus body 101 are stacked on the sheet catch section 102A.

<Structure of Development Unit>

Figure 2:
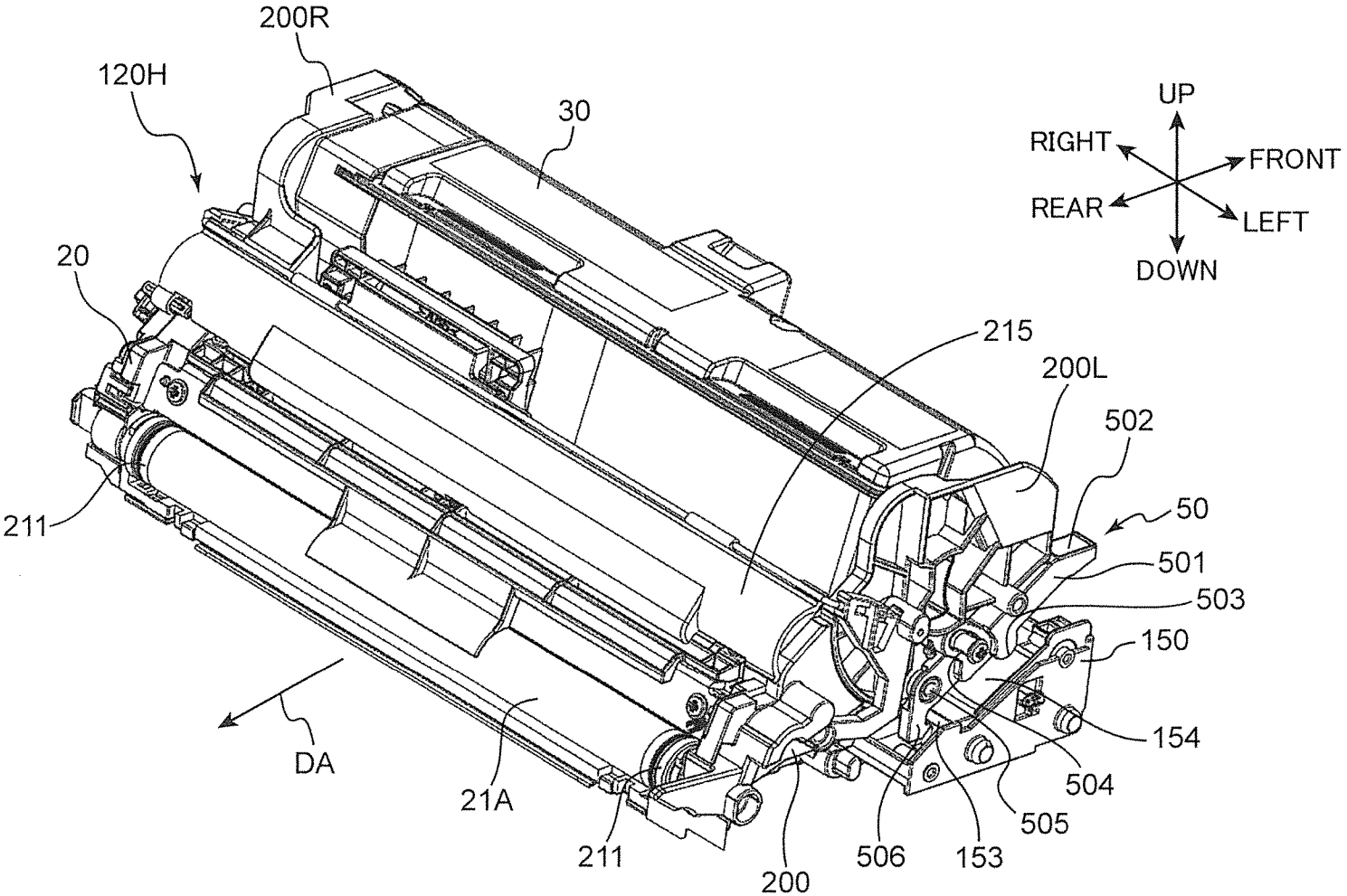
FIG. 2 is a perspective view depicting a development unit and an apparatus body unit (a portion of an apparatus body) each equipped in an image forming apparatus.
Figure 3:
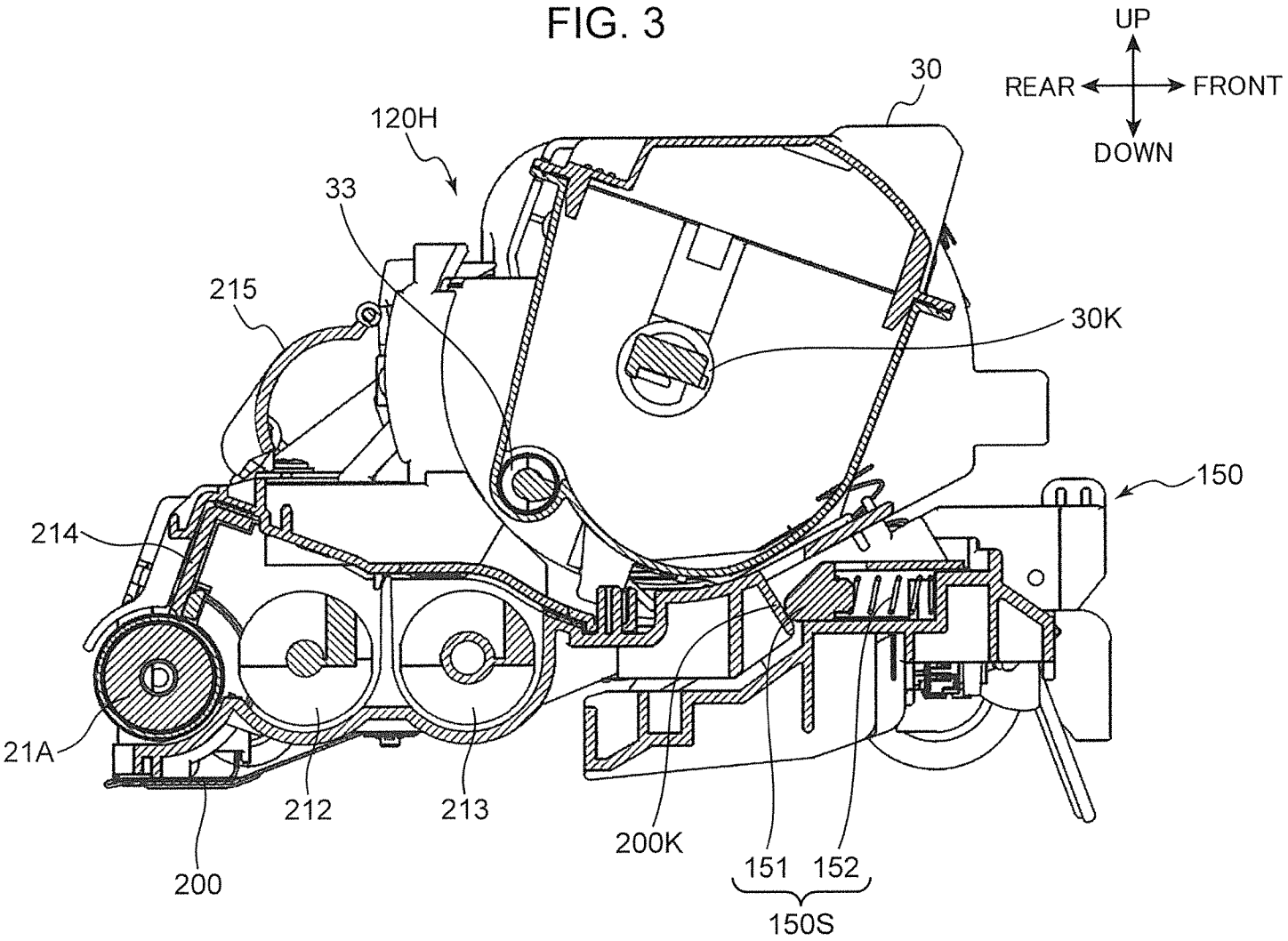
FIG. 3 is a sectional view depicting the development unit and the apparatus body unit.

Next, with reference to FIGS. 2 and 3, the development unit 120H will be described in detail. FIG. 2 is a perspective view of the development unit 120H and an aftermentioned apparatus body unit 150 (a portion of the apparatus body 101). FIG. 3 is a sectional view depicting the development unit 120H and the aftermentioned apparatus body unit 150.

As mentioned above, the development unit 120H includes the development device 20 and the toner container 30. The development unit 120H is configured to be mountable and demountable with respect to the apparatus body 101 along a given mounting-demounting direction. That is, the toner container 30 can be mounted to the apparatus body 101 integrally with the development device 20. In this regard, it should be understood that, in the case where the development device 20 is first mounted to the apparatus body 101, the toner container 30 may be mounted by itself to the development device 20 disposed inside the apparatus body 101. The arrowed line DA in FIGS. 1 and 2 indicates a mounting direction of the development unit 120H with respect to the apparatus body 101.

The image forming apparatus 100 further includes an apparatus body unit 150. This apparatus body unit 150 makes up a portion of the apparatus body 101. This apparatus body unit 150 functions to guide the mounting and demounting of the development unit 120H. When the front cover 106 is opened with respect to the apparatus body 101, the apparatus body unit 150 is exposed to an outside of the apparatus body 101. The development unit 120H is mounted in the internal space 107 of the apparatus body 101, in such a manner that it passes by and above the apparatus body unit 150. The apparatus body unit 150 includes a positioning mechanism 150S (FIG. 3), an engagement target portion 153 (FIG. 2), and a guide surface 154 (FIG. 2).

The positioning mechanism 150S is disposed at each of opposite ends of the apparatus body unit 150 in a rightward-leftward (lateral) direction in a paired manner. The positioning mechanism 150S includes a contact member 151 and a biasing spring 152. The contact member 151 is configured to come into contact with a pressing target portion 200K (FIG. 3) of the development unit 120H mounted to the apparatus body 101. The biasing spring 152 acts to urge the contact member 151 rearwardly. In other words, the positioning mechanism 150S including the biasing spring 152 acts to urge the development unit 120H mounted at a development position inside the apparatus body 101, rearwardly, to set a position of the development unit 120H.

The guide surface 154 is defined by an upper surface of the apparatus body unit 150. The guide surface 154 has a function of guiding the mounting of the development unit 120H. The guide surface 154 has an inclined region extending rearwardly and obliquely downwardly. In the guide surface 154, a rear end region located rearward of the inclined region is formed as a horizontal region. The engagement target portion 153 is located closer to a distal end of the development unit 120H in the mounting direction (the direction indicated by the arrowed line DA in FIG. 2), than the guide surface 154. The engagement target portion 153 is configured to enable a hook 506 of an aftermentioned lock lever 50 to be engaged therewith.

<Development Device>

Figure 4:
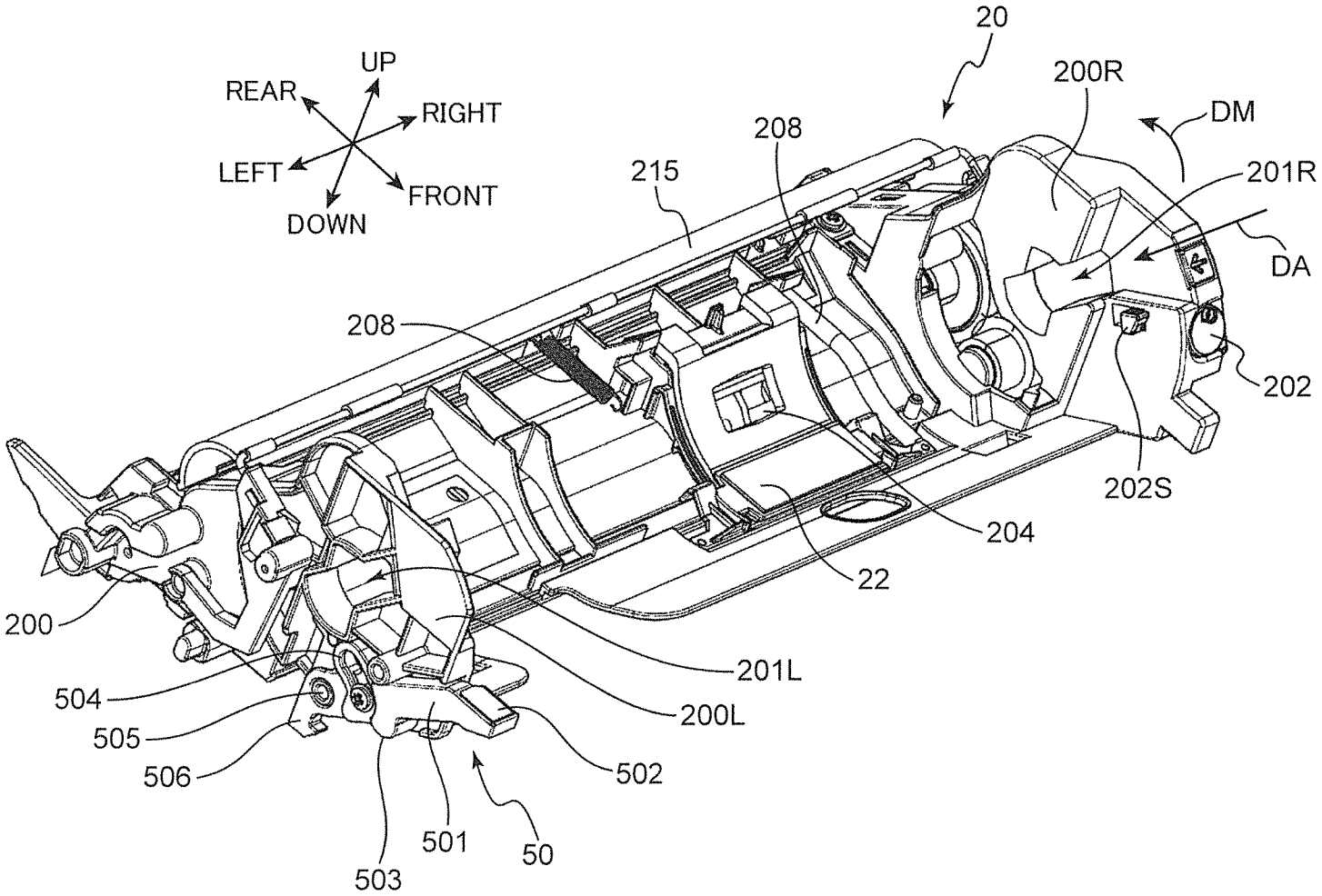
FIG. 4 is a perspective view depicting a development device constituting the development unit.

With reference to FIG. 4 in addition to FIGS. 2 and 3, the development device 20 will be described. FIG. 4 is a perspective view depicting the development device 20 constituting the development unit 120H. The development device 20 includes a development housing 200, a development roller 21A, a contact roller 211, a first screw 212, a second screw 213, a layer thickness regulation member 214, and a development roller cover 215.

The development housing 200 is designed to support each member of the development device 20. The development housing 200 has a function of supporting the toner container 30. Referring to FIG. 4, the development housing 200 has a left wall 200L, a right wall 200R, and a toner supplementing port 204. The left wall 200L and the right wall 200R are standingly provided, respectively, at laterally opposite ends of the development housing 200. The toner container 30 can be mounted between the left wall 200L and the right wall 200R of the development housing 200.

The right wall 200R of the development housing 200 includes a right guide groove 201R, a locking contact piece 202S, and a lock button 202. The left wall 200L includes a left guide groove 201L. The right guide groove 201R and the left guide groove 201L are grooves respectively formed on the right wall 200R and the left wall 200L of the development housing 200. These guide grooves 201R, 201L are formed along the mounting direction (indicated by the arrowed line DA in FIG. 4) of the toner container 30 with respect to the development housing 200. The right guide groove 201R is configured to allow an aftermentioned right guide 311 (FIG. 5) of the toner container 30 to be entered thereinto. Similarly, the left guide groove 201L is configured to allow an aftermentioned left guide 301 (FIG. 7) formed on a left end wall of the toner container 30 to be entered thereinto.

The toner container 30 is inserted into a space on an upper side of the development housing 200, and then rotated in the direction indicated by the arrowed line DM in FIG. 4, as mentioned later. As a result, an aftermentioned toner discharge port 30P of the toner container 30 is positioned to face the toner supplementing port 204, so that it becomes possible to supplementarily supply toner from the toner container 30 to the development device 20. A dead end of each of the right and left guide groove 201R, 201L is formed in a sector shape (FIG. 4) to permit rotation of a corresponding one of the aftermentioned right and left guides 311, 301 of the toner container 30. A mounting structure of the toner container 30 with respect to the development housing 200 of the development device 20 will be described in more detail later.

The locking contact piece 202S is operable to lock the toner container 30 after the toner container 30 is rotated in the direction indicated by the arrowed line DM. In this state, when the lock button 202 is depressed, the toner container 30 is unlocked, so that it becomes possible to rotate the toner container 30 in a direction opposite to the direction indicated by the arrowed line DM. Subsequently, the toner container 30 can be pulled out in a direction opposite to the direction indicated by the arrowed line DA and demounted from the development device 20.

The development roller 21A is rotatably supported by the development housing 200. A rotational axis of the development roller 21A is parallel to a rotational axis of the photosensitive drum 121. The development roller 21A is configured to support developer containing toner, on an outer peripheral surface thereof. The development roller 21A is operable to supply toner to the photosensitive drum 121 to develop an electrostatic latent image on the photosensitive drum 121. The contact roller 211 is composed of a pair of rollers disposed, respectively, at axially opposite ends of the development roller 21A. The pair of contact rollers 211 is kept in contact with the surface of the photosensitive drum 121 to maintain a distance between the development roller 21A and the photosensitive drum 121 constant.

Each of the first screw 212 and the second screw 213 is provided with a spiral blade on an outer peripheral surface of a shaft thereof, and rotatably supported inside the development housing 200. The developer in the development housing 200 is circulatingly conveyed by the first screw 212 and the second screw 213. In the development housing 200, the second screw 213 is disposed in opposed relation to the toner supplementing port 204. The developer is supplied to the development roller 21A by the first screw 212.

The layer thickness regulation member 214 is operable to regulate a thickness of a layer of developer supplied on the development roller 21A. The development roller cover 215 is swingably attached to the development housing 200. FIG. 2 depicts a state in which the development roller cover 215 is retracted above the development roller 21A. The development roller cover 215 can be swung downwardly from the position depicted in FIG. 2 so as to cover the development roller 21A. Thus, when the development unit 120H is demounted from the apparatus body 101, it is possible to suppress a situation where foreign substances are adhered to the development roller 21A, or surroundings of the development roller 21A are contaminated by toner on the development roller 21A.

The development device 20 further includes a lock lever 50 (FIGS. 2 and 4). The lock lever 50 is swingably provided on the left wall 200L of the development housing 200 of the development device 20. The lock lever 50 is configured such that a posture thereof is changeable between a lock posture in which it locks the development unit 120H (development device 20) at the development position inside the apparatus body 101, and an unlock posture in which it unlocks the development unit 120H and permits the unlocked development unit 120H to be demounted from the apparatus body along the mounting-demounting direction.

The lock lever 50 includes a lever body 501, a pressing target portion 502, a contact portion 503, a guide groove 504, a pivot portion 505, and a hook 506.

The lever body 501 is a body of the lock lever 50. The pressing target portion 502 is a flat portion provided on an upper end of the lever body 501. In an operation for demounting the development unit 120H from the apparatus body 101, an operator can first depress the pressing target portion 502 of the lock lever 50. The contact portion 503 is provided in an approximately central region of the lock lever 50 in the forward-rearward direction and formed in a circular arc shape protruding downwardly. In the state after the development unit 120H is mounted to the apparatus body 101, the contact portion 503 of the lock lever 50 is located in opposed relation to the guide surface 154 of the apparatus body unit 150, as depicted in FIG. 2.

The guide groove 504 is a grooved portion located rearward of the contact portion 503 and formed with an open groove. The open groove of the guide groove 504 is formed in a circular arc shape having a center at the pivot portion 505. The pivot portion 505 is provided at a rear end of the lever body 501. The pivot portion 505 is rotatably supported by the left wall 200L of the development housing 200. The pivot portion 505 serves as a pivot point for a swinging movement of the lock lever 50. The contact portion 503 is located between the pivot portion 505 and the pressing target portion 502. The hook 506 is provided on a side opposite to the pressing target portion 502 with respect to the pivot portion 505. The hook 506 is engageable with the engagement target portion 153 of the apparatus body unit 150. As depicted in FIG. 4, the hook 506 is formed to extend downwardly from the pivot portion 505 and have a distal end curved forwardly (trailing side of the mounting direction of the development unit 12H).

<Structure of Toner Container>

Figure 5:
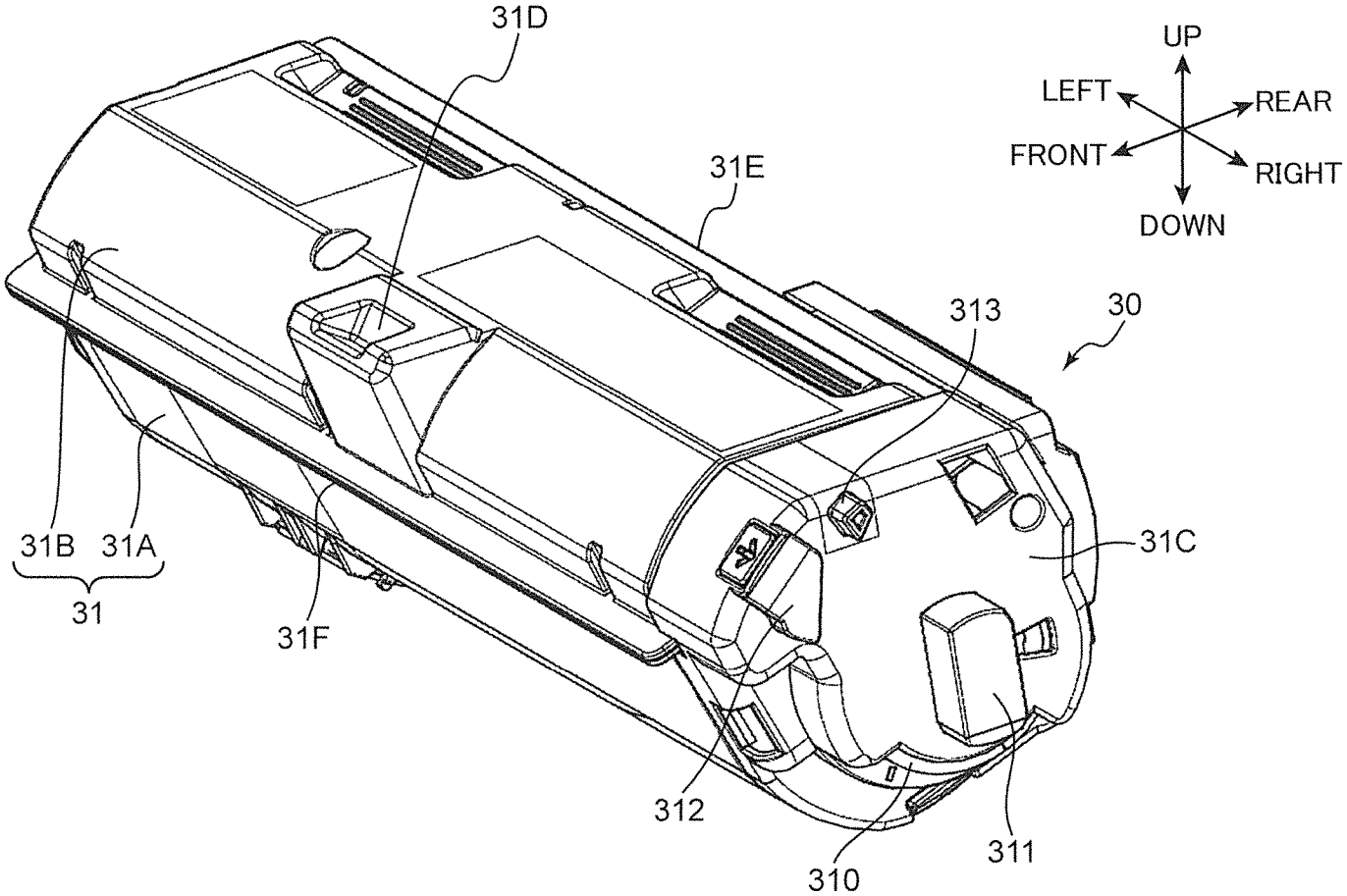
FIG. 5 is a perspective view depicting a toner container constituting the development unit.

With reference to FIG. 5 in addition to FIGS. 2 and 3, the toner container 30 will be described. The toner container 30 is designed to store toner (developer) thereinside. The toner container 30 includes a container body 31 and a container cover 31C.

The container body 31 is formed in a shape having a given length in the rightward-leftward (lateral) direction and extending in the rightward-leftward direction. That is, during operation of mounting the toner container 30 to the development device 20 located inside the apparatus body 101, the container body 31 is positioned such that a longitudinal direction thereof is oriented in the rightward-leftward direction. The container body 31 is formed in a container shape capable of storing toner thereinside, and includes a base portion 31A and a lid portion 31B. The base portion 31A forms a lower portion of the container body 31, and a top surface thereof is formed as an opening.

The lid portion 31B is fixed to the base portion 31A in such a manner as to close the opening of the base portion 31A. In this embodiment, the lid portion 31B is fixedly welded to the base portion 31A. In this process, the base portion 31A and the lid portion 31B are fixed together through respective container flanges 31F thereof each formed along a peripheral edge of the opening of the base portion 31A. The lid portion 31B includes a first grip section 31D and a second grip section 31E. During operation of mounting the toner container 30 to the development device 20, or during operation of mounting the development unit 120H including the toner container 30 and the development device 20 to the apparatus body 101, an operator can grip the first grip section 31D and the second grip section 31E.

The container cover 31C is attached to a right end portion of the container body 31. The container cover 31C includes a right guide 311, a transmission gear 310, a first lock engagement portion 312, and a second lock engagement portion 313. The right guide 311 is a rectangular parallelepiped-shaped portion protruding outwardly from the container cover 31C. Although not appearing in FIG. 5, the aftermentioned left guide 301 having the same shape as the right guide 311 is provided on a left end portion of the toner container 30 (see FIG. 6). These guides 301, 311 are configured to guide the mounting of the toner container 30 to the development device 20. The transmission gear 310 is operable to transmit a rotational driving force to an aftermentioned container paddle 30K. Each of the first lock engagement portion 312 and the second lock engagement portion 313 is a protrusion protruding outwardly from the container cover 31C. Details of the first lock engagement portion 312 and the second lock engagement portion 313 will be described later.

The toner container 30 further includes a container screw 33 and a container paddle 30K (FIG. 3).

The container screw 33 is provided with a spiral blade on an outer peripheral surface of a shaft thereof, and disposed inside the container body 31. The container screw 33 is rotatably supported by the base portion 31A of the container body 31 in such a manner as to extend in the rightward-leftward (lateral) direction along a bottom wall of the base portion 31A. More specifically, the container screw 33 is disposed inside the container body 31 to extend over between laterally opposite ends of the container body 31. The container screw 33 is operable, when being rotated, to convey toner stored inside the container body 31, toward an aftermentioned toner discharge port 30P (FIG. 7) formed in the bottom wall of the base portion 31A. When an aftermentioned container shutter 32 (FIG. 6) supported by the container body 31 is slidingly moved, the aftermentioned toner discharge port 30P is opened, so that toner is allowed to be discharged from the toner container 30.

The container paddle 30K is disposed inside the container body 31 while being rotatably supported by the base portion 31A, and operable to stir toner stored inside the container body 31. In this embodiment, the container paddle 30K is disposed such that a rotational axis thereof extends in rightward-leftward direction, i.e., in a direction parallel to the rotational axis of the photosensitive drum 121. The container paddle 30K is configured to be rotated by a rotational driving force transmitted via the transmission gear 310 provided in the container cover 31C.

Figure 6:
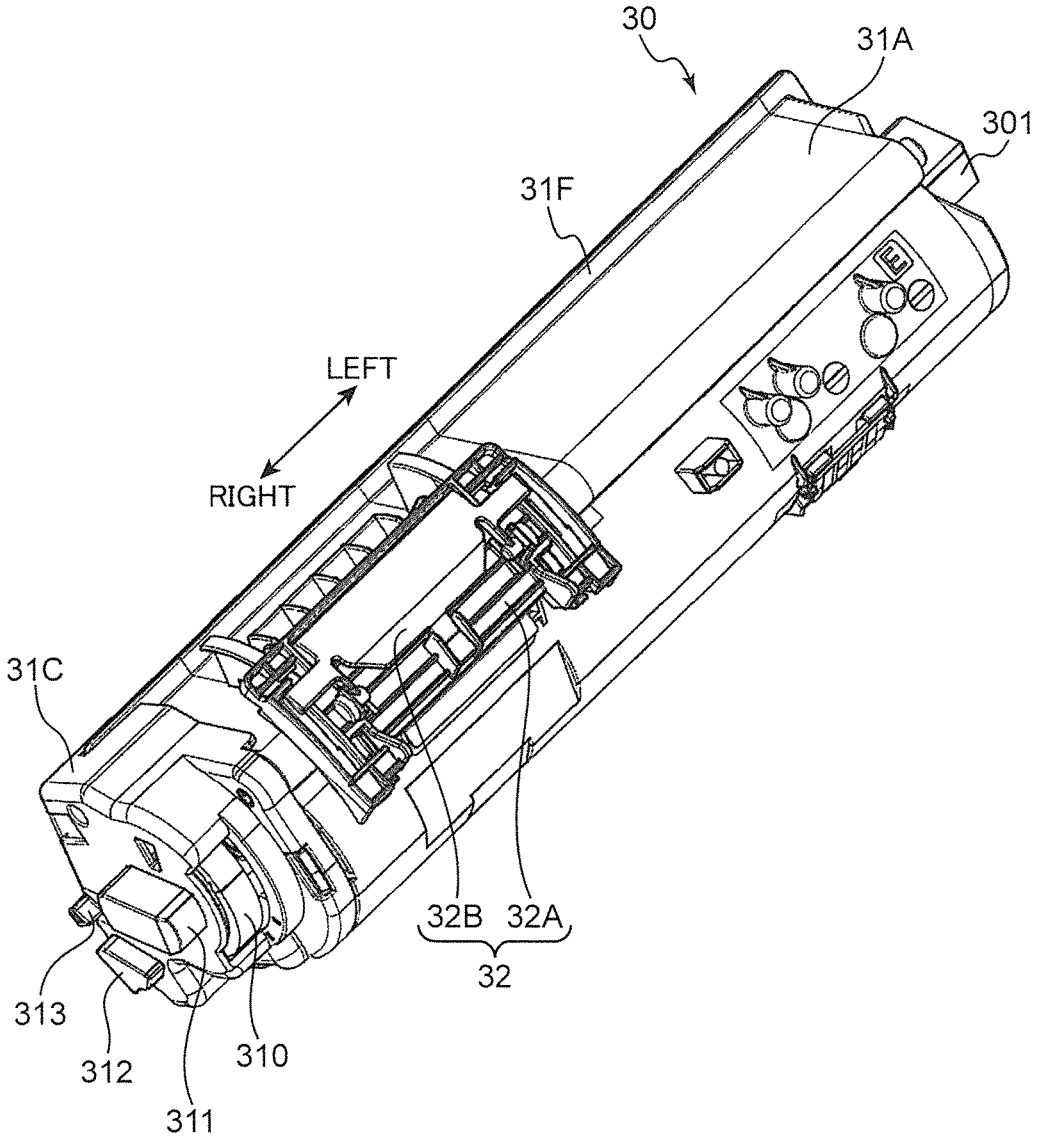
FIG. 6 is a perspective view depicting the toner container.
Figure 7:
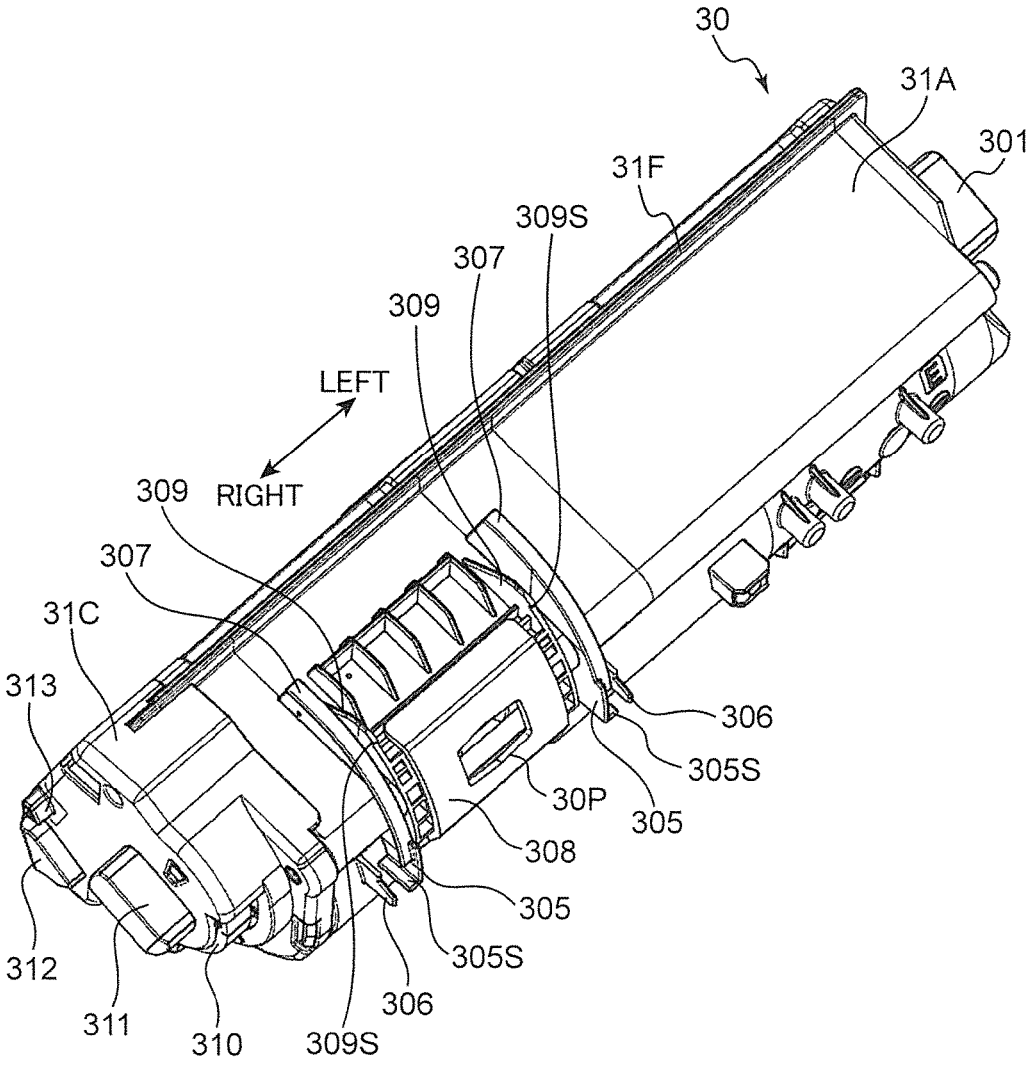
FIG. 7 is a perspective view depicting the toner container in a state in which a container shutter is removed therefrom.
Figure 8A:
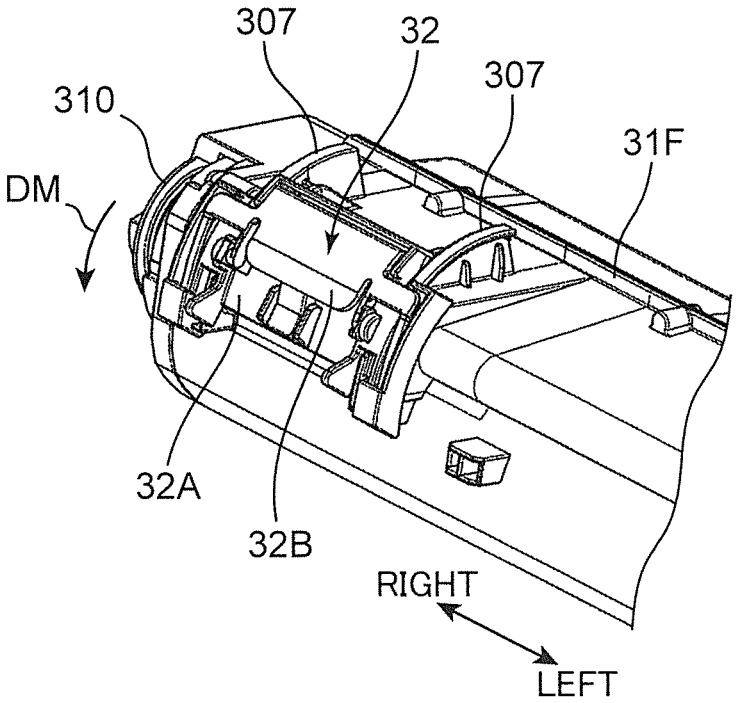
FIG. 8A is a perspective enlarged view depicting a portion of the toner container around the container shutter, in a state in which a toner discharge port is sealingly closed by the container shutter.
Figure 8B:
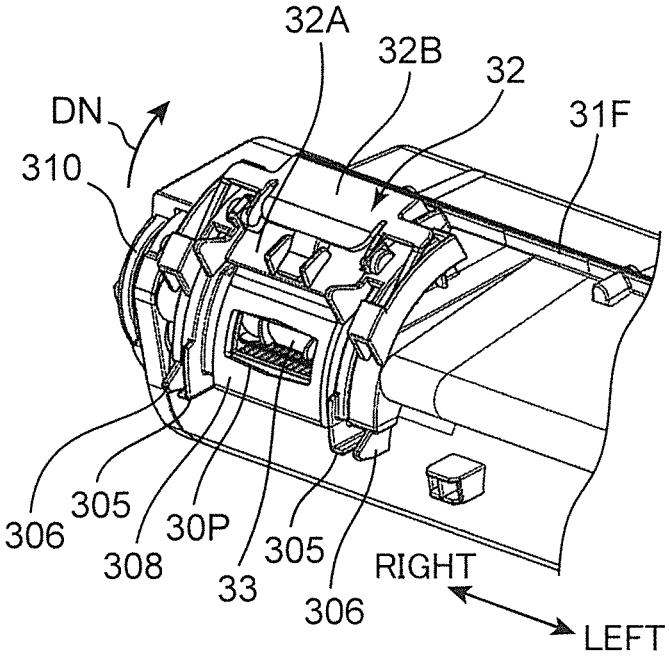
FIG. 8B is a perspective enlarged view depicting a portion of the toner container around the container shutter, in a state in which the toner discharge port is opened.
Figure 9A:
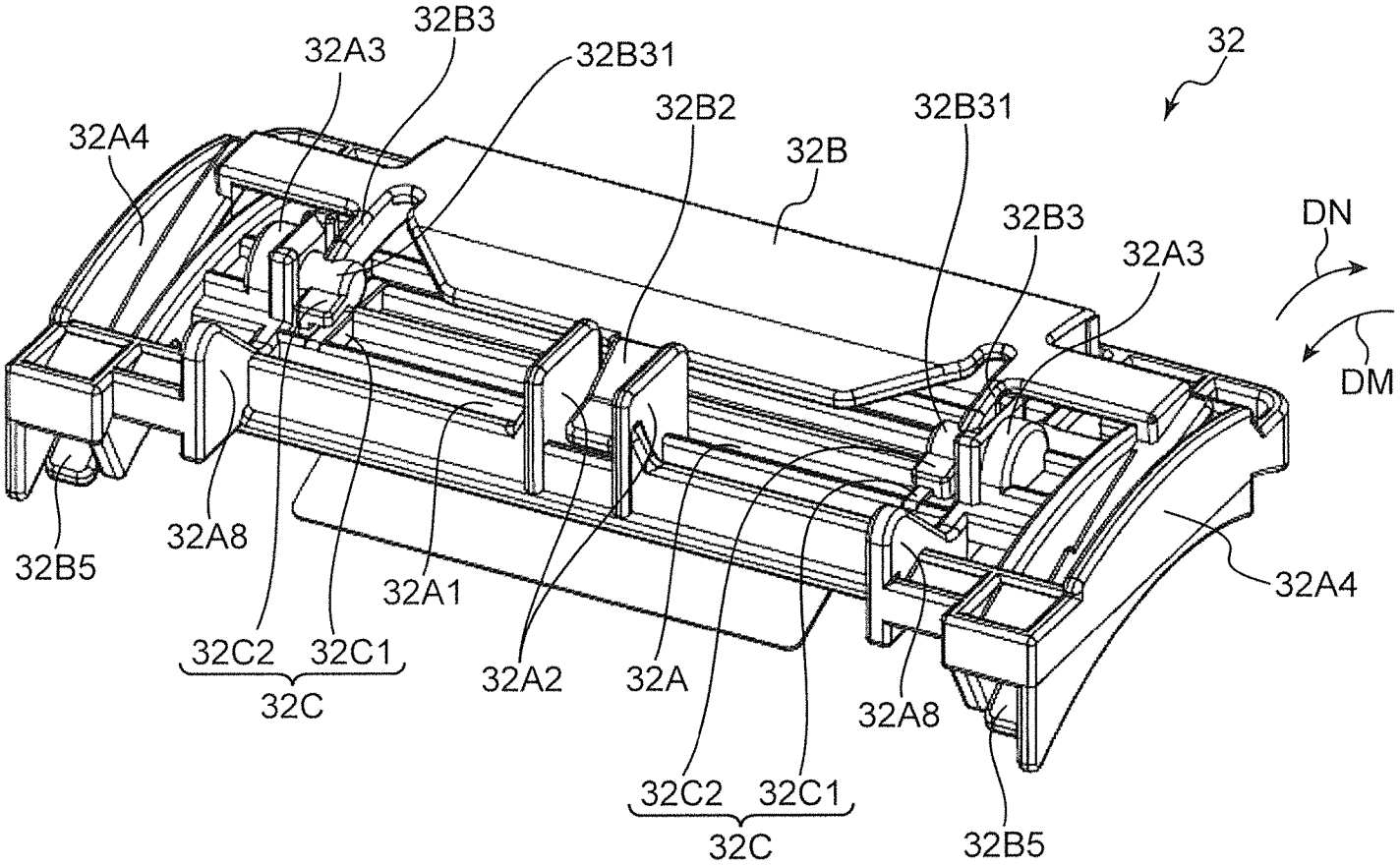
FIG. 9A is a perspective view depicting the container shutter, as viewed from an outside of the toner container.
Figure 9B:
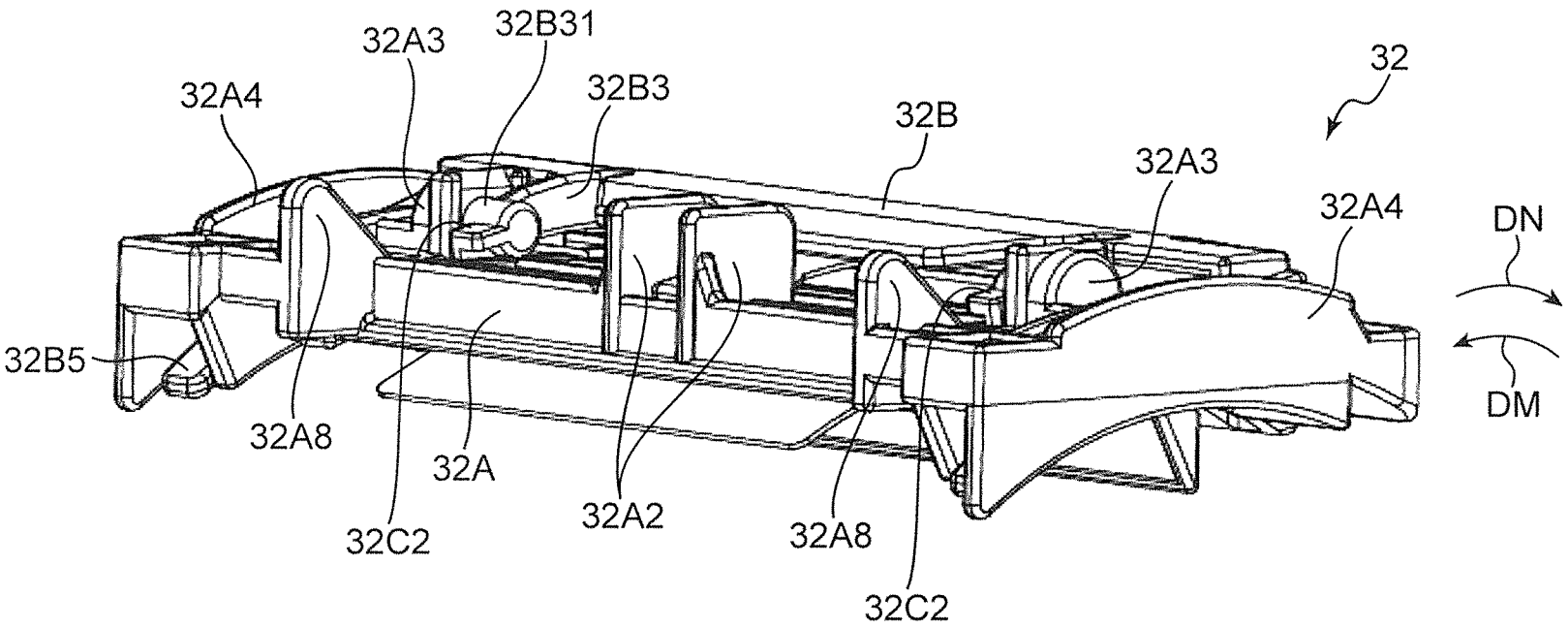
FIG. 9B is a perspective view depicting the container shutter, as viewed from the outside of the toner container at a different angle from that in FIG. 9A.
Figure 9C:
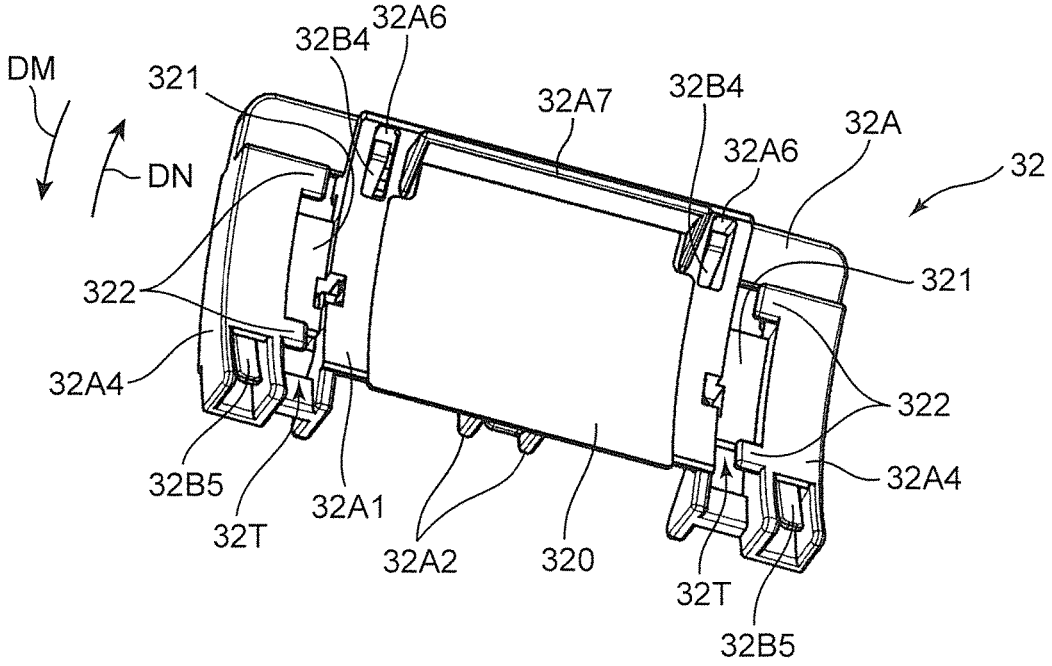
FIG. 9C is a perspective view depicting the container shutter, as viewed from an inside of the toner container.
Figure 10:
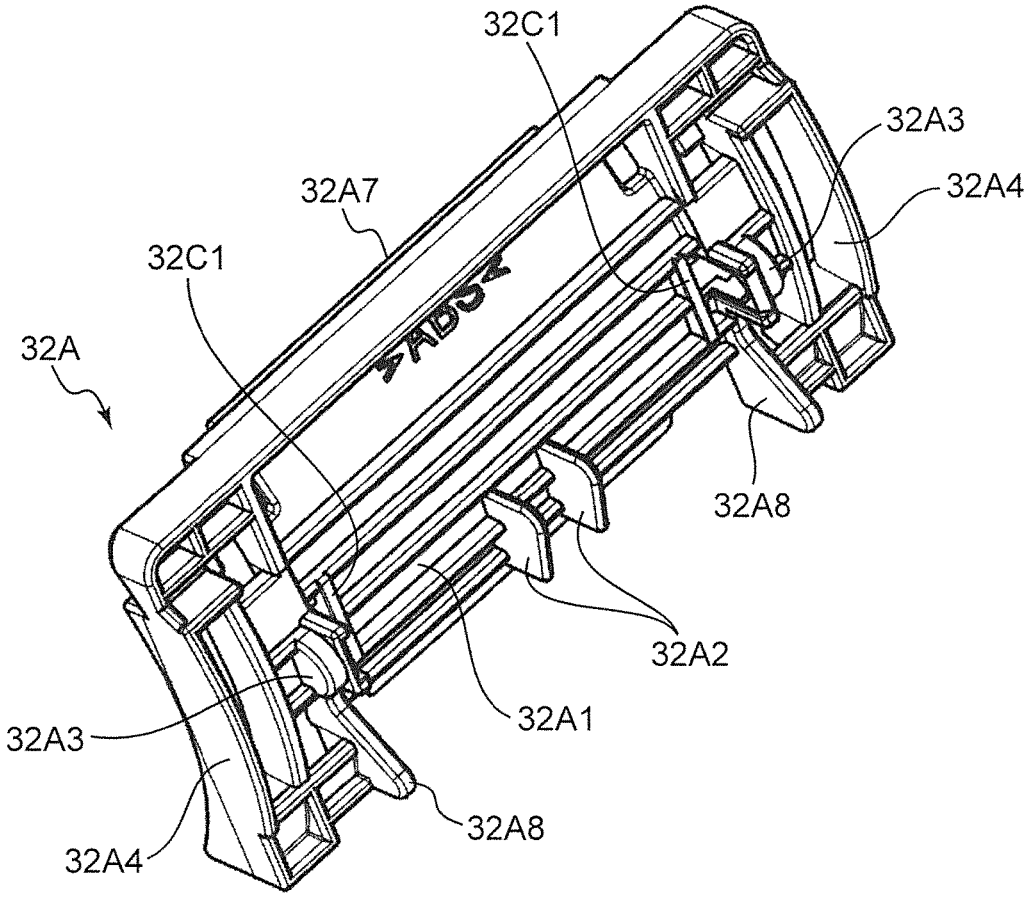
FIG. 10 is a perspective view depicting a shutter body of the container shutter.
Figure 11A:
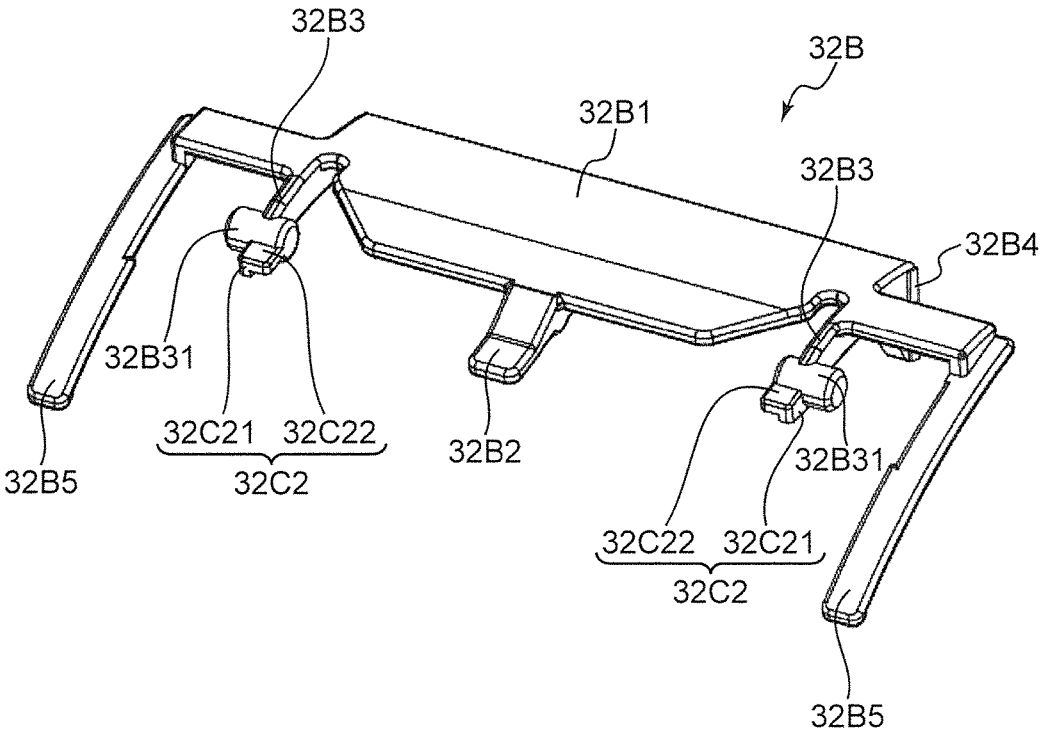
FIG. 11A is a perspective view depicting a shutter stopper of the container shutter.
Figure 11B:
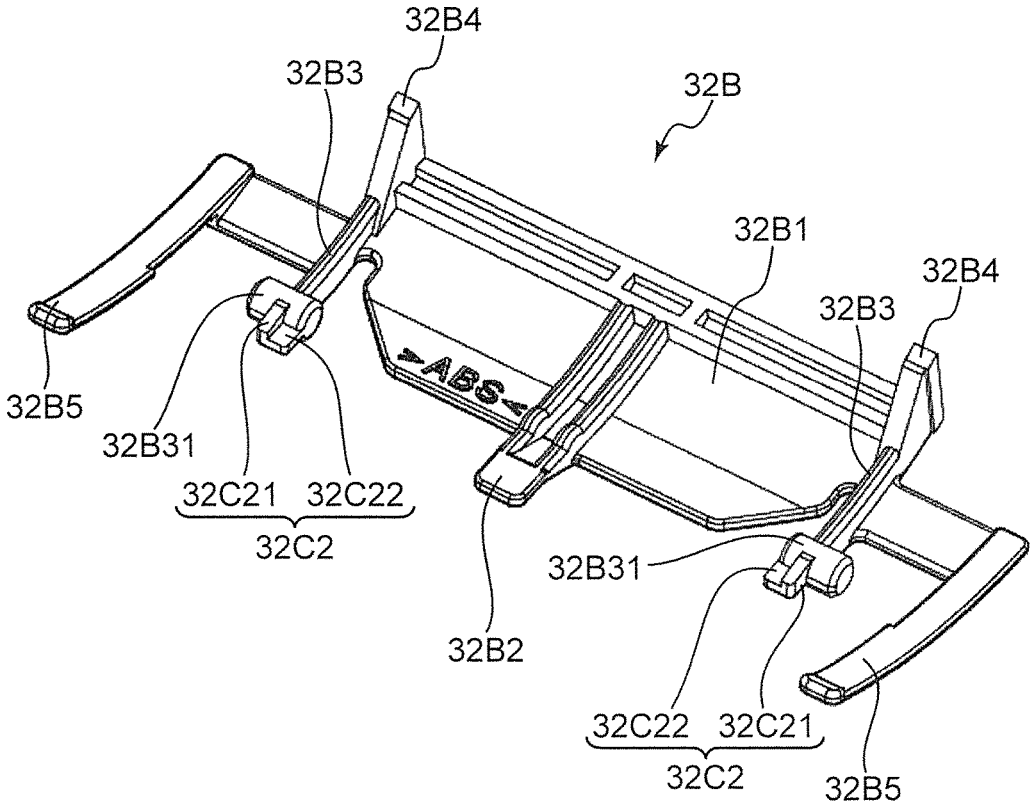
FIG. 11B is a perspective view depicting the shutter stopper of the container shutter, as viewed at a different angle from that in FIG. 11A.
Figure 12A:
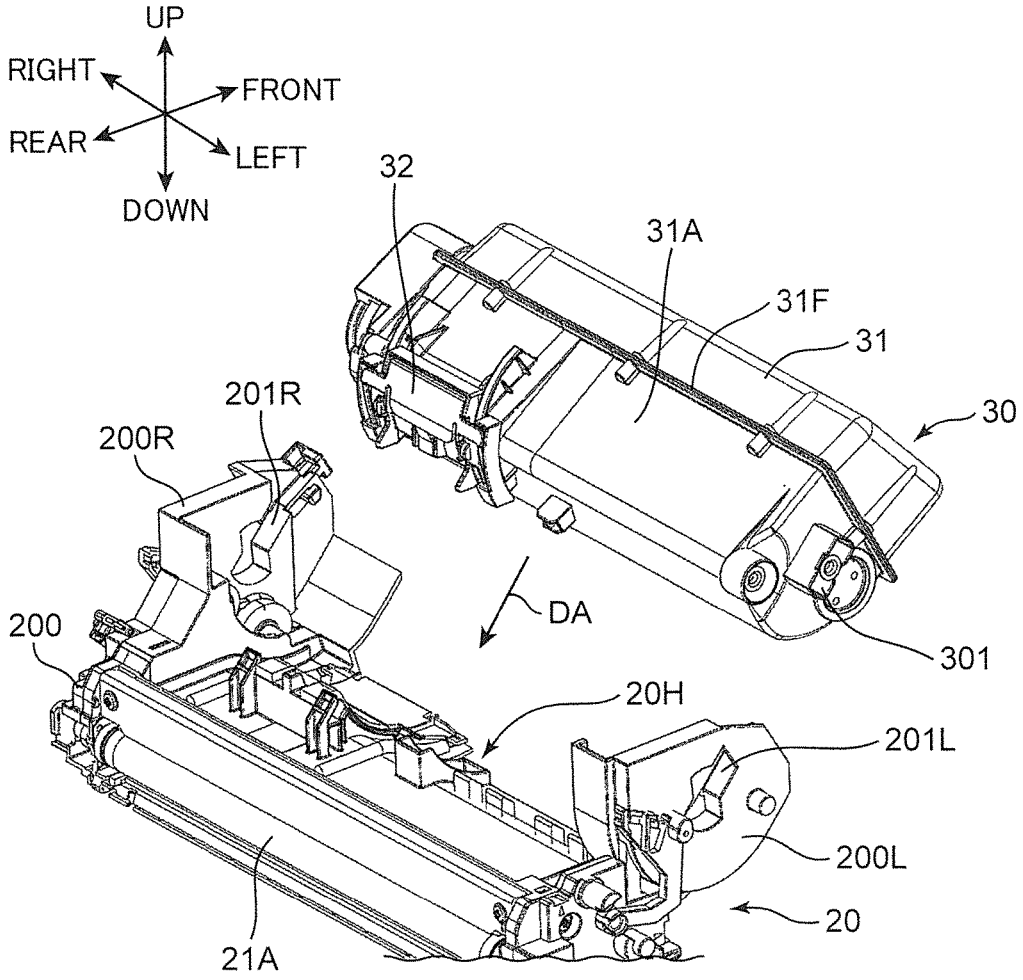
FIG. 12A is a perspective view depicting a state when the toner container is being mounted to the development device.
Figure 12B:
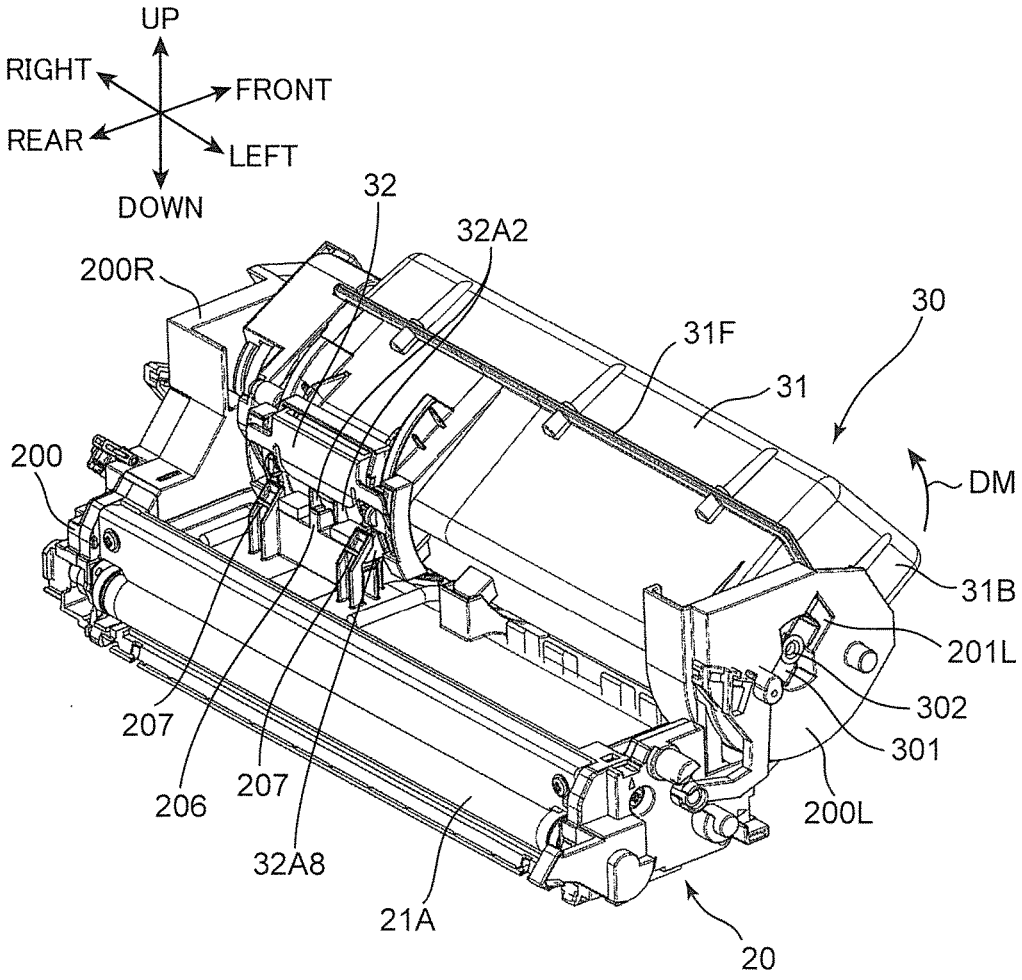
FIG. 12B is a perspective view depicting a state when the toner container is being mounted to the development device.
Figure 12C:
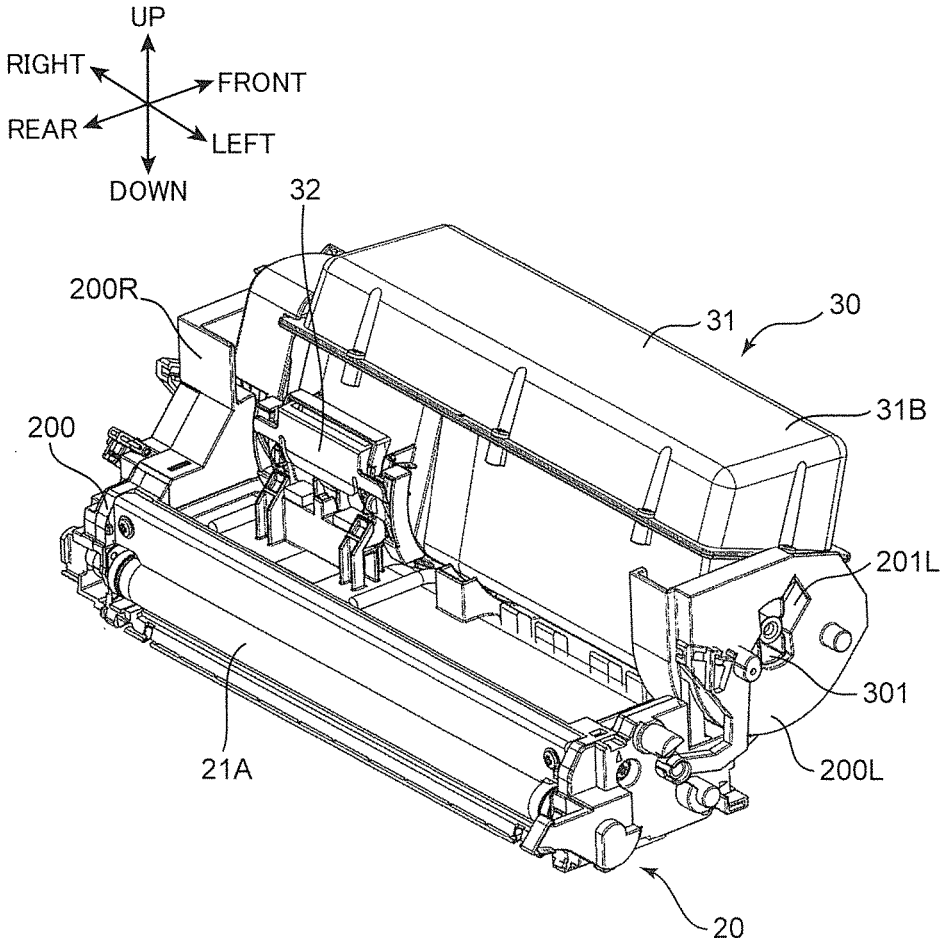
FIG. 12C is a perspective view depicting a state after the toner container is mounted to the development device.

With reference to FIGS. 6 to 12C, the toner container 30 will be further described in detail. FIG. 6 is a perspective view depicting the toner container 30. FIG. 7 is a perspective view depicting the toner container 30 in a state in which the aftermentioned container shutter 32 is removed therefrom. FIG. 8A is a perspective enlarged view depicting a portion of the toner container 30 around the aftermentioned container shutter 32, in a state in which the aftermentioned toner discharge port 30P is sealingly closed by the aftermentioned container shutter 32, and FIG. 8B is a perspective enlarged view depicting a portion of the toner container 30 around the aftermentioned container shutter 32, in a state in which the aftermentioned toner discharge port 30P is opened. FIGS. 9A and 9B are perspective views depicting the aftermentioned container shutter 32, as viewed from an outside of the toner container 30, and FIG. 9C is a perspective view depicting the aftermentioned container shutter 32, as viewed from an inside of the toner container 30. FIG. 10 is a perspective view depicting a shutter body 32A of the aftermentioned container shutter 32. FIGS. 11A and 11B are perspective views depicting a shutter stopper 32B of the aftermentioned container shutter 32. FIGS. 12A and 12B are perspective views depicting a state when the toner container 30 is being mounted to the development device 20, and FIG. 12C is a perspective view depicting a state after the toner container 30 is mounted to the development device.

First, referring to FIG. 12A, the development device 20 has a container mounting section 20H between the right wall 200R and the left wall 200L of the development housing 200. The container mounting section 20H is configured to allow the toner container 30 to be mounted thereto. The toner container 30 can be mounted to the container mounting section 20H (FIG. 12B), while being guided along the mounting direction (indicated by the arrowed line DA in FIG. 12A) by the left guide groove 201L and the right guide groove 201R. A posture of the container body 31 to be taken just after the container body 31 is insertingly mounted to the container mounting section 20H in the development housing 200 of the development device 20, as depicted in FIG. 12B, is defined as a first posture. In the first posture, the aftermentioned toner discharge port 30P formed in the container body 31 is located away upwardly from the toner supplementing port 204 of the development device 20, so that the toner discharge port 30P has not yet communicated with the toner supplementing port 204.

Subsequently, the container body 31 of the toner container 30 is rotated about the axis of the container paddle 30K in given one direction (a first rotation direction, the direction indicated by the arrowed line DM in FIG. 12B), so that the posture of the container body 31 is changed from the first posture depicted in FIG. 12B to the posture depicted in FIG. 12C. This posture the container body 31 to be taken after the container body 31 is rotated in the first rotation direction, as depicted in FIG. 12C, is defined as a second posture. In the second posture, the aftermentioned toner discharge port 30P formed in the container body 31 communicates with the toner supplementing port 204 of the development device 20, so that it becomes possible to supplementarily supply toner to the development device 20. That is, the container body 31 of the toner container 30 is capable of being changed in posture between a first posture (posture in FIG. 12B) to be taken just after it is insertingly mounted to the container mounting section 20H of the development device 20, and a second posture (posture in FIG. 12C) to be taken after it is rotated from the first posture in the first rotation direction.

The toner container 30 further includes a container shutter 32 (FIG. 6), a toner discharge port 30P (FIG. 7) (developer discharge port), a left guide 301 (FIG. 6), a paddle bearing portion 302 (FIG. 12B), a container shutter pressing portion 305 (FIG. 7), an elastic piece pressing portion 306 (FIG. 7), a guide rib 307 (FIG. 7), a raised discharge portion 308 (FIG. 7), a container shutter lock rib 309 (FIG. 7), a transmission gear 310 (FIG. 7), a right guide 311 (FIG. 7), a first lock engagement portion 312, and a second lock engagement portion 313.

The toner discharge port 30P is an opening formed in a right end of the bottom wall of the base portion 31A. More specifically, the raised discharge portion 308 is formed to be raised from the bottom wall of the base portion 31A to have an arc-shaped outer peripheral surface, and the toner discharge port 30P is opened in the outer peripheral surface of the raised discharge portion 308 to form an approximately rectangular shape. Toner stored inside the toner container 30 is discharged from the toner discharge port 30P and supplementarily supplied to the development device 20.

The left guide 301 is a protrusion formed on the left end wall of the base portion 31A to have an elongate shape extending in a given direction, and functions to restrict the mounting direction (direction indicated by the arrowed line DA in FIG. 12A) of the toner container 30 with respect to the development device 20. The left guide 301 is formed in an internally hollowed structure. The paddle bearing portion 302 is provided inside the left guide 301. The paddle bearing portion 302 rotatably supports the container paddle 30K. The same bearing portion as the paddle bearing portion 302 on the side of the left guide 301 is also provided inside the right guide 311, so as to rotatably support a shaft of the container paddle 30K at a position adjacent to the transmission gear 310.

The container shutter pressing portion 305 is composed of a pair of ribs provided to protrude outwardly and arranged on both sides of the raised discharge portion 308 formed with the toner discharge port 30P, in the longitudinal direction of the toner container 30 (in the rightward-leftward direction). The container shutter pressing portion 305 is located downstream of the toner discharge port 30P in the first rotation direction (indicated by the arrowed line DM in FIG. 12B) of the container body 31 during mounting. Each of the pair of ribs composing the container shutter pressing portion 305 is formed to extend along the first rotation direction and have a distal end (container shutter pressing piece 305S) with a shape bent to extend along the longitudinal direction of the toner container 30 (expand in the rightward-leftward direction). The container shutter pressing piece 305S has a function of pressing an aftermentioned housing shutter 22 and of being pressed by the aftermentioned housing shutter 22.

The elastic piece pressing portion 306 is composed of a pair of protruding pieces each protruding from the base portion 31A at a position adjacent to a respective one of the container shutter pressing pieces 305S of the container shutter pressing portion 305. The pair of protruding pieces composing the elastic piece pressing portion 306 are arranged on both sides of the pair of ribs 305 composing the container shutter pressing portion 305, in the rightward-leftward direction. The elastic piece pressing portion 306 is disposed to extend along the first rotation direction of the container body 31, and formed in a stepped shape having a protruded height which increases stepwise in a direction away from the toner discharge port 30P. The elastic piece pressing portion 306 is disposed in opposed relation to an elastic piece 32B5 of an aftermentioned shutter stopper 32B, so as to have a function of pressing the elastic piece 32B5.

The guide rib 307 is composed of a pair of arc-shaped rib members provided to protrude outwardly from the base portion 31A and coupled to the container shutter pressing portion 305. The guide rib 307 is formed to extend along the first rotation direction of the container body 31. The pair of arc-shaped rib members composing the guide rib 307 are arranged on both sides of the toner discharge port 30P in the rightward-leftward direction. The guide rib 307 is formed to extend toward a side opposite to the container shutter pressing pieces 305S, with respect to the toner discharge port 30P, to have a distal end opposed to the container flange 31F. Each of the pair of arc-shaped rib members composing the guide rib 307 has an outer peripheral wall bent in the rightward-leftward direction to have a given width. In the container body 31, the guide rib 307 functions to support the container shutter 32 in such a manner as to be slidingly movable about a give axis.

The container shutter lock rib 309 is composed of a pair of ribs each extending from a respective one of right and left edges of the raised discharge portion 308, along a rotation direction of the container body 31. More specifically, each of the pair of ribs composing the container shutter lock rib 309 extends from the lateral edge of the raised discharge portion 308, toward a rotation direction of the container body 31 during operation of demounting the toner container 30 from the development device 20 (a second rotation direction opposite to the first rotation direction, the direction indicated by the arrowed line DN in FIG. 8B). The container shutter lock rib 309 is formed with an engagement target portion 309S which is a pawl-shaped stepped portion. In the container body 31, the engagement target portion 309S of the container shutter lock rib 309 is provided adjacent to the toner discharge port 30P, and configured such that an engagement piece 32B4 of the aftermentioned shutter stopper 32B is engageable therewith.

The transmission gear 310 is a rotary gear rotatably supported by a right end wall of the toner container 30. The transmission gear 310 has a function of transmitting a rotational driving force to the container paddle 30K. When the toner container 30 is mounted to the development device 20, a non-depicted gear set of the development device 20 is coupled to the transmission gear 310 to enable a rotational driving force to be input from the gear set into the transmission gear 310.

The first lock engagement portion 312 is a protrusion protruding from the right end wall of the container cover 31C at a position spaced apart from the right guide 311. Similarly, the second lock engagement portion 313 is a protrusion protruding from the container cover 31C. The first lock engagement portion 312 and the second lock engagement portion 313 are engageable with the locking contact piece 202S of the development device 20.

With reference to FIGS. 8A to 11B, the container shutter 32 will be described in detail. The container shutter 32 is supported by the container body 31 in such a manner as to be slidingly movable with respect to the toner discharge port 30P in response to the postural change of the container body 31, and operable to sealingly close or open the toner discharge port 30P (FIGS. 8A and 8B). In this process, the container shutter 32 is slidingly moved along the guide rib 307 of the container body 31. The container shutter 32 includes a shutter body 32A, a shutter stopper 32B (swingable member), and a shaft displacement restriction portion 32C.

The shutter body 32A is an approximately rectangular plate-shaped member formed such that it is curved along an outer peripheral surface of the container body 31. The shutter body 32A has a sealing surface for sealingly closing the toner discharge port 30P. The shutter body 32A includes a shutter plate portion 32A1, a pressing target piece support portion 32A2, a stopper shaft support portion 32A3, an elastic piece support portion 32A4, a shutter hole 32A6, a shutter contact portion 32A7, a shutter engagement piece 32A8, a container shutter sheet 320, a guide target surface 321, and a guide target piece 322.

The shutter plate portion 32A1 is a main portion of the shutter body 32A, and is an approximately rectangular plate-shaped member. The container shutter sheet 320 is a sheet member bonded to the shutter plate portion 32A1 of the shutter body 32A to define the sealing surface for sealingly closing the toner discharge port 30P. In this embodiment, the container shutter sheet 320 is composed of a film member made of a resin material.

The guide target surface 321 is provided between the shutter plate portion 32A1 and the elastic piece support portion 32A4 at a depressed level with respect to the shutter plate portion 32A1. The guide target piece 322 is composed of a pair of protrusions provided to protrude from an aftermentioned bottom wall of the elastic piece support portion 32A4 at positions upstream and downstream of the guide target surface 321 in the first rotation direction (the direction indicated by the arrowed line DM in FIG. 9C). Between the guide target surface 321 and the guide target piece 322, a space extending along the first rotation direction is formed. By inserting one end of the guide rib 307 of the toner container 30 into the above space guide from a guide insertion opening 32T in FIG. 9C, the container shutter 32 is mounted to the container body 31. Thus, the container shutter 32 becomes slidingly movable with respect to the container body 31.

The pressing target piece support portion 32A2 is composed of a pair of protruding pieces provided on a back surface of the shutter plate portion 32A1 on a side opposite to the sealing surface (defined by the container shutter sheet 320 bonded to the shutter plate portion 32A1) to protrude outwardly from a longitudinally (laterally) central region of the back surface. An aftermentioned pressing target piece 32B2 of the shutter stopper 32B is disposed between the pair of protruding pieces composing the pressing target piece support portion 32A2. In this manner, the pair of protruding pieces composing the pressing target piece support portion 32A2 supports the aftermentioned pressing target piece 32B2.

The stopper shaft support portion 32A3 is composed of a pair of bearing portions each provided on the back surface of the shutter plate portion 32A1 on the side opposite to the sealing surface at a position longitudinally outward of a respective one of the pair of protruding pieces composing the pressing target piece support portion 32A2. The stopper shaft support portion 32A3 rotatably supports a pair of stopper shaft portions 32B31 of an aftermentioned stopper pivot portion 32B3. The elastic piece support portion 32A4 is composed of a pair of grooved portions each provided laterally outward of a respective one of the pair of bearing portions composing the stopper shaft support portion 32A3. Each of the pair of grooved portions composing the elastic piece support portion 32A4 is formed of a bottom wall flush with the shutter plate portion 32A1 and a pair of lateral walls. The aftermentioned elastic piece 32B5 of the shutter stopper 32B is received in the elastic piece support portion 32A4. In this manner, the elastic piece support portion 32A4 supports the aftermentioned elastic piece 32B5.

The hole 32A6 is composed of a pair of elongate holes penetratingly opened in the shutter plate portion 32A1. The hole 32A6 is opened at a leading end of the shutter plate portion 32A1 in the second rotation direction (indicated by the arrowed line DN in FIG. 9C). The contact portion 32A7 is am elongate protrusion formed between the pair of the holes 32A6, and each of longitudinally opposite ends thereof is bent toward a downstream side in the first rotation direction. The contact portion 32A7 has a function of restricting a movement of the container shutter 32 in the second rotation direction. The engagement piece 32A8 is composed of a part of protruding pieces each protrudingly provided between the shutter plate portion 32A1 and a respective one of the pair of grooved portions composing the elastic piece support portion 32A4, in the longitudinal direction. The engagement piece 32A8 is formed in an approximately rectangular shape. The engagement piece 32A8 is configured to be engageable with an aftermentioned container shutter fixing portion 207 (FIG. 12B) of the development device 20.

The shutter stopper 32B is a swingable member mountable to the back surface of the shutter plate portion 32A1 of the shutter body 32A on the side opposite to the sealing surface (defined by the container shutter sheet 320 bonded to the shutter plate portion 32A1). The shutter stopper 32B includes a stopper plate 32B1, a stopper pressing target piece 32B2, a stopper pivot portion 32B3, a stopper engagement piece 32B4, and an elastic piece 32B5.

The stopper plate 32B1 is a main portion of the shutter stopper 32B, and is an approximately rectangular plate-shaped member. The pivot portion 32B3 is composed of a pair of protruding pieces each provided to protrude from a respective one of longitudinally opposite ends of the stopper plate 32B1. Each of the pair of protruding pieces composing the pivot portion 32B3 has a distal end provided with a shaft portion 32B31 slightly protruding therefrom. Each of the pair of shaft portions 32B31 is inserted into and supported by a respective one of the pair of bearing portions composing the stopper shaft support portion 32A3 of the shutter body 32A.

The shutter stopper 32B is mounted to the back surface of the shutter body 32A in such a manner as to be swingable about the pair of shaft portions 32B31. Then, the shutter stopper 32B is swingable between a sliding movement restriction position where it restricts the sliding movement of the container shutter 32, and a sliding movement permission position where it permits the sliding movement of the container shutter 32. In a state in which the shutter stopper 32B swung with respect to the shutter body 32A is set to the sliding movement restriction position, the shutter stopper 32B restricts sliding movement of the container shutter 32. On the other hand, in a state in which the shutter stopper 32B swung with respect to the shutter body 32A is set to the sliding movement permission position, the shutter stopper 32B permits sliding movement of the container shutter 32. Thus, the toner discharge port 30P formed in the bottom wall of the base portion 31A of the container body 31 can be sealingly closed and opened by the container shutter 32 in a stable manner.

The engagement piece 32B4 is composed of a pair of protruding pieces each provided to protrude from a respective one of longitudinally opposite ends of the stopper plate 32B1. The engagement piece 32B4 is formed in an approximately triangular shape. The engagement piece 32B4 is coupled to the pivot portion 32B3 in the first rotation direction. The engagement piece 32B4 is engageable with the engagement target portion 309S of the container shutter lock rib 309 of the container body 31.

The shutter stopper 32B is configured such that, at the sliding movement restriction position, the engagement piece 32B4 is engaged with the engagement target portion 309S, and at the sliding movement permission position, the engagement between the engagement piece 32B4 and the engagement target portion 309S is released. In other words, in the state in which the shutter stopper 32B is set to the sliding movement restriction position, the engagement piece 32B4 is engaged with the engagement target portion 309S to restrict sliding movement of the container shutter 32. On the other hand, in the state in which the shutter stopper 32B is set to the sliding permission restriction position, the engagement between the engagement piece 32B4 and the engagement target portion 309S is released to permit sliding movement of the container shutter 32.

The pressing target piece 32B2 is a protruding piece provided to protrude from a longitudinally central region of the stopper plate 32B1. More specifically, the pressing target piece 32B2 is formed to protrude from the stopper plate 32B1 toward the downstream side in the first rotation direction. In the shutter stopper 32B, the pressing target piece 32B2 is disposed on a side opposite to the engagement piece 32B4 with respect to the pair of shaft portions 32B31. Further, the pressing target piece 32B2 is disposed between the pair of protruding pieces composing the pressing target piece support portion 32A2 of the shutter body 32A, as mentioned above. When the toner container 30 is mounted to container mounting section 20H of the development device 20, a pressing force is applied from an aftermentioned stopper pressing portion 206 (FIG. 12B) of the development housing 200 to the pressing target piece 32B2. When the pressing force is applied to the pressing target piece 32B2 in this manner, the shutter stopper 32B is swung from the sliding movement restriction position to the sliding movement permission position.

The elastic piece 32B5 is composed of a pair of elongate-shaped protruding pieces each provided at a respective one of longitudinal opposite ends of the shutter stopper 32B. The elastic piece 32B5 is formed such that it extends in the first rotation direction, and a distal end thereof becomes a free end.

When the pair of shaft portions 32B31 of the shutter stopper 32B are inserted, respectively, into the pair of bearing portions composing the stopper shaft support portion 32A3 to integrate the shutter body 32A and the shutter stopper 32B together, the pair of protruding pieces composing the engagement piece 32B4 are inserted, respectively, into the pair of elongate holes composing the hole 32A6 (FIG. 9C). Further, the pair of elongate-shaped protruding pieces composing the elastic piece 32B5 are received, respectively, inside the pair of grooved portions composing the elastic piece support portion 32A4. In this process, as depicted in FIG. 9C, the distal end of the elastic piece 32B5 is exposed to the side of the sealing surface of the shutter body 32A.

The shaft displacement restriction portion 32C is configured to restrict axial movement of the pair of shaft portions 32B31 of the shutter stopper 32B. The shaft displacement restriction portion 32C can suppress a situation where the pair of shaft portions 32B31 of the shutter stopper 32B are demounted from the pair of bearing portions composing the stopper shaft support portion 32A3 of the shutter body 32A. In other words, the shaft displacement restriction portion 32C can suppress a situation where the shutter stopper 32B having a function of restricting or permitting sliding movement of the container shutter 32 is demounted from the shutter body 32A. Thus, it becomes possible to improve stability in sealingly closing and opening of the toner discharge port 30P formed in the container body 31, by the container shutter 32.

In this embodiment, the shaft displacement restriction portion 32C includes a pair of shaft movement restriction protruding pieces 32C1 and a pair of shaft movement restriction protrusions 32C2. As depicted in FIG. 10, each of the pair of shaft movement restriction protruding pieces 32C1 is a protruding piece provided on the back surface of the shutter plate portion 32A1 of the shutter body 32A on the side opposite to the sealing surface (defined by the container shutter sheet 320 bonded to the shutter plate portion 32A1), in longitudinally spaced-apart and opposed relation to a respective one of the pair of bearing portions composing the stopper shaft support portion 32A3. As depicted in FIGS. 11A and 11B, each of the pair of shaft movement restriction protrusions 32C2 is a protrusion protruding from a respective one of the pair of shaft portions 32B31 of the shutter stopper 32B. Each of the pair of shaft movement restriction protrusions 32C2 is configured such that it is sandwiched between corresponding ones of the pair of bearing portions composing the stopper shaft support portion 32A3 and the pair of shaft movement restriction protruding pieces 32C1.

More specifically, each of the pair of shaft movement restriction protrusions 32C2 includes a first protrusion section 32C21 and a second protrusion section 32C22. In each of the pair of shaft movement restriction protrusions 32C2, the first protrusion section 32C21 is formed in a rectangular shape, wherein, in the state in which the pair of shaft portions 32B31 of the shutter stopper 32B are supported, respectively, by the pair of bearing portions composing the stopper shaft support portion 32A3 of the shutter body 32A, the first protrusion section 32C21 is disposed between corresponding ones of the pair of bearing portions composing the stopper shaft support portion 32A3 and the pair of shaft movement restriction protruding pieces 32C1. Further, in each of the pair of shaft movement restriction protrusions 32C2, the second protrusion section 32C22 is formed in a rectangular shape to extend from one edge of the first protrusion section 32C21 in a direction orthogonal at a right angle.

In the state in which the pair of shaft portions 32B31 are supported, respectively, by the pair of bearing portions composing the stopper shaft support portion 32A3, each of the pair of shaft movement restriction protrusions 32C2 is sandwiched between corresponding ones of the pair of bearing portions composing the stopper shaft support portion 32A3 and the pair of shaft movement restriction protruding pieces 32C1, so that the shaft displacement restriction portion 32C can restrict axial movement of the pair of shaft portions 32B31 of the shutter stopper 32B.

<Mounting and Demounting of Toner Container with Respect to Development Device>

Figure 13:
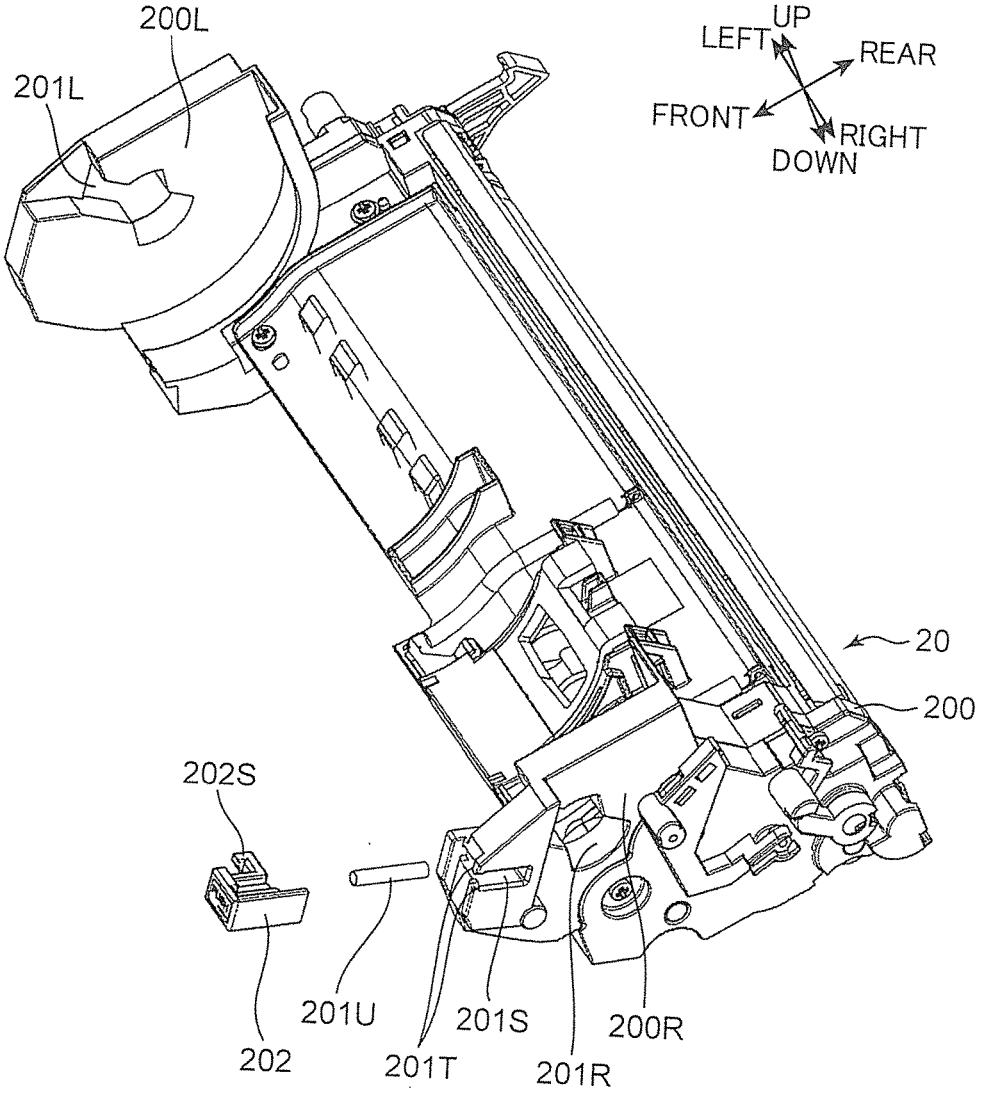
FIG. 13 is an exploded perspective view depicting the development device.
Figure 14A:
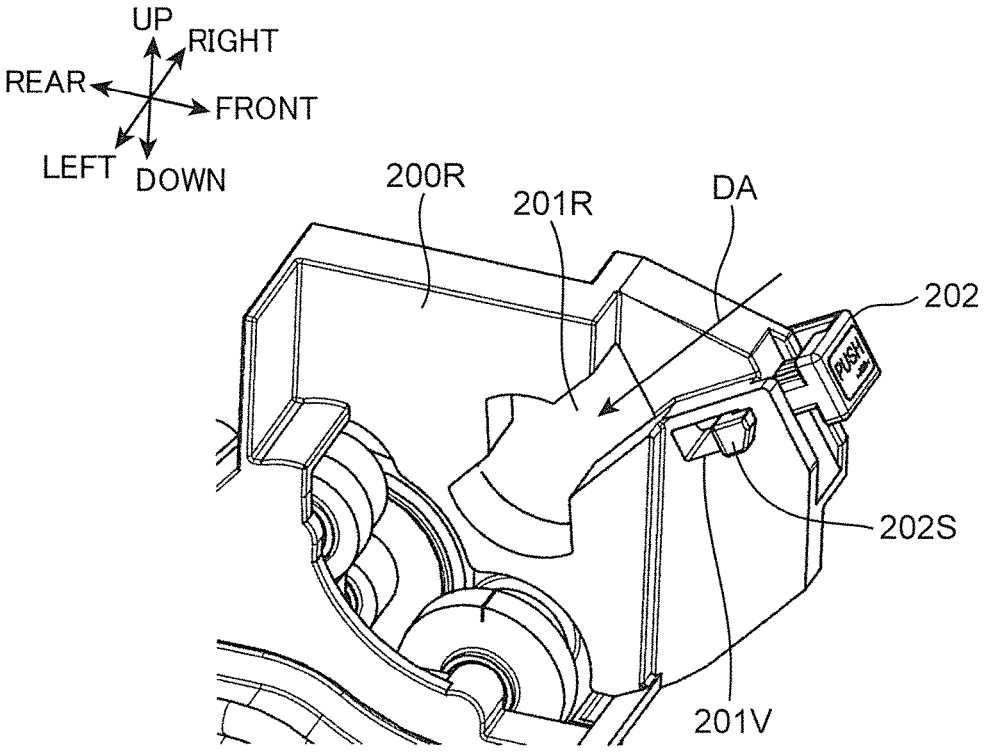
FIG. 14A is a perspective enlarged view depicting a portion of the development device.
Figure 14B:
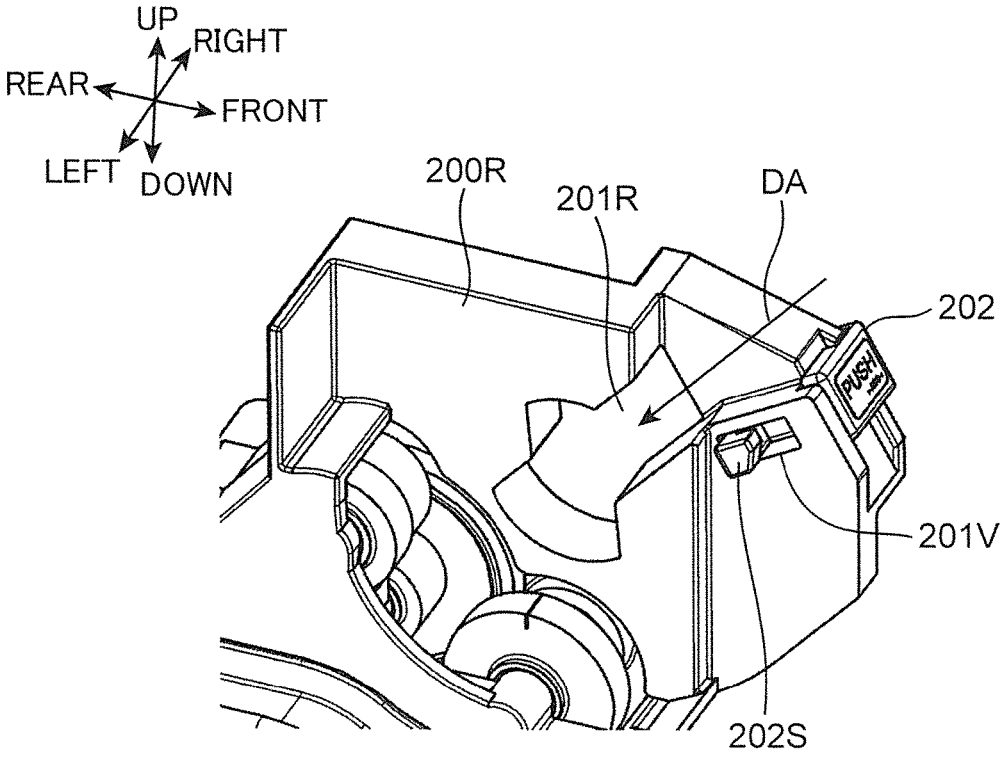
FIG. 14B is a perspective enlarged view depicting a portion of the development device.
Figure 15:
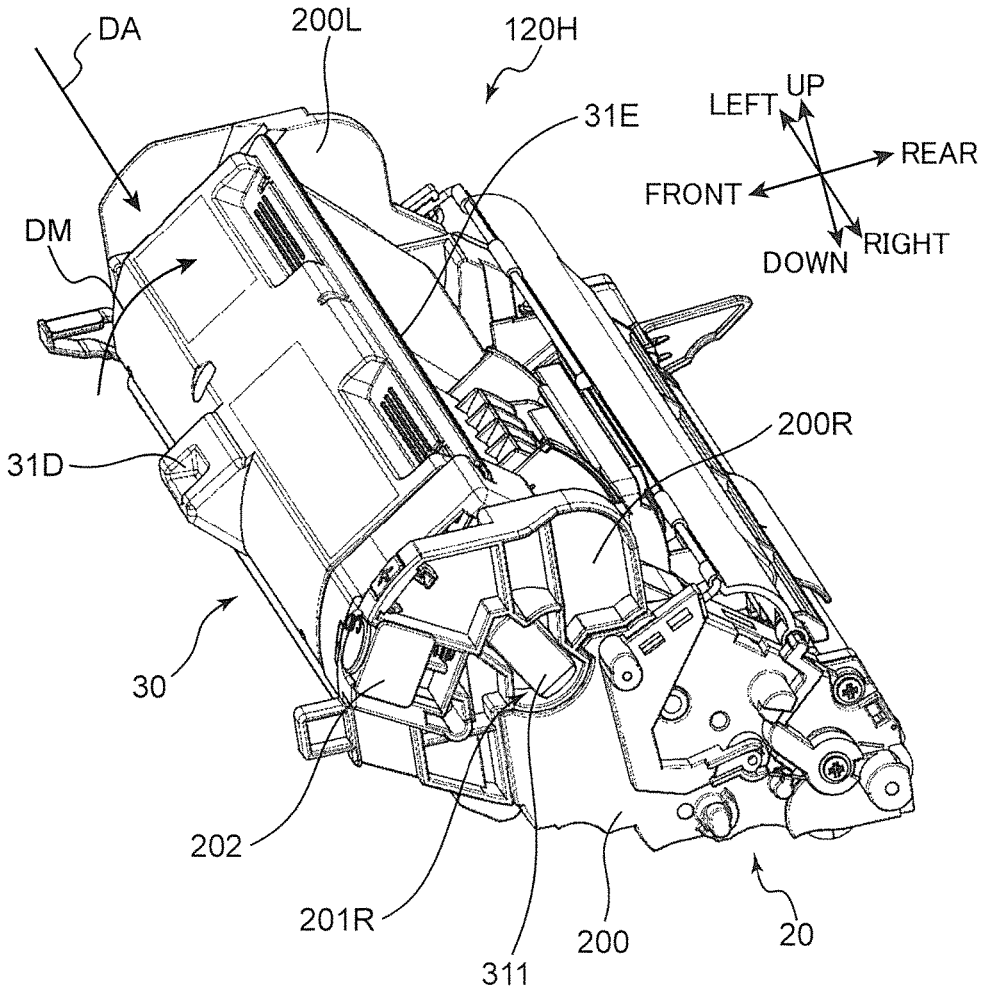
FIG. 15 is a perspective view depicting a state when the toner container is mounted to the development device.
Figure 16A:
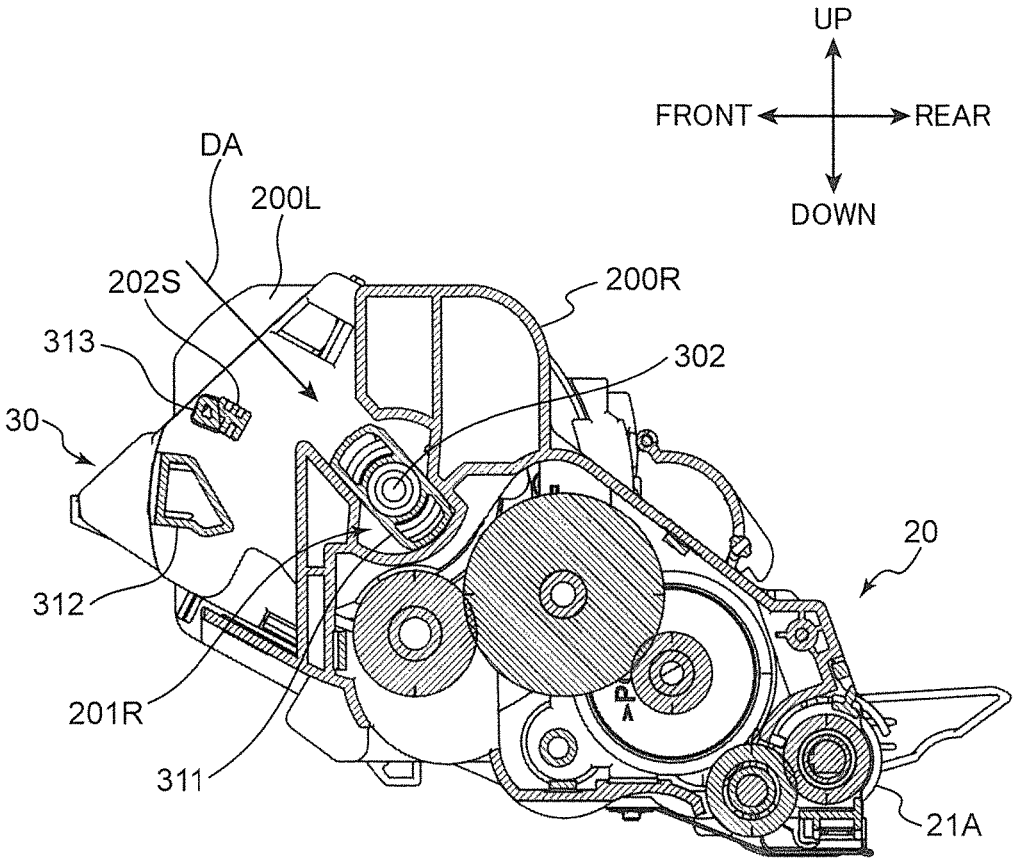
FIG. 16A is a sectional view depicting a state when the toner container is mounted to the development device.
Figure 16B:
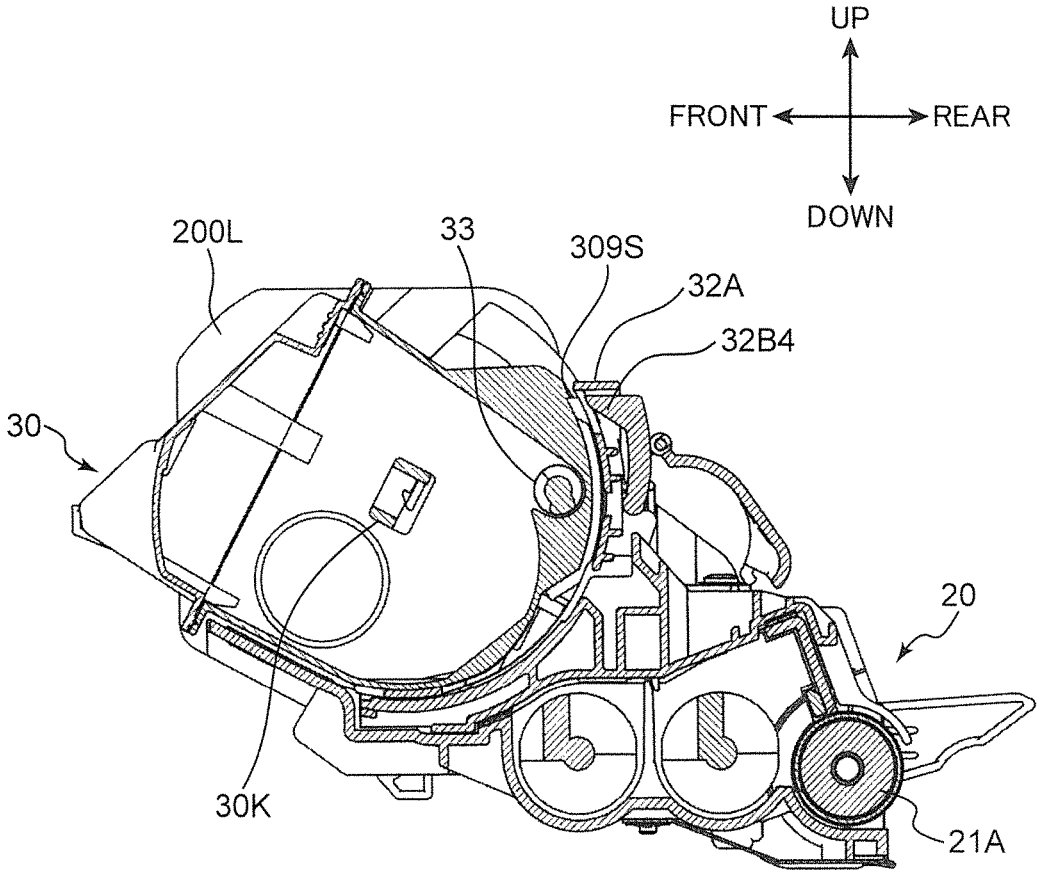
FIG. 16B is a sectional view depicting a state when the toner container is mounted to the development device.
Figure 16C:
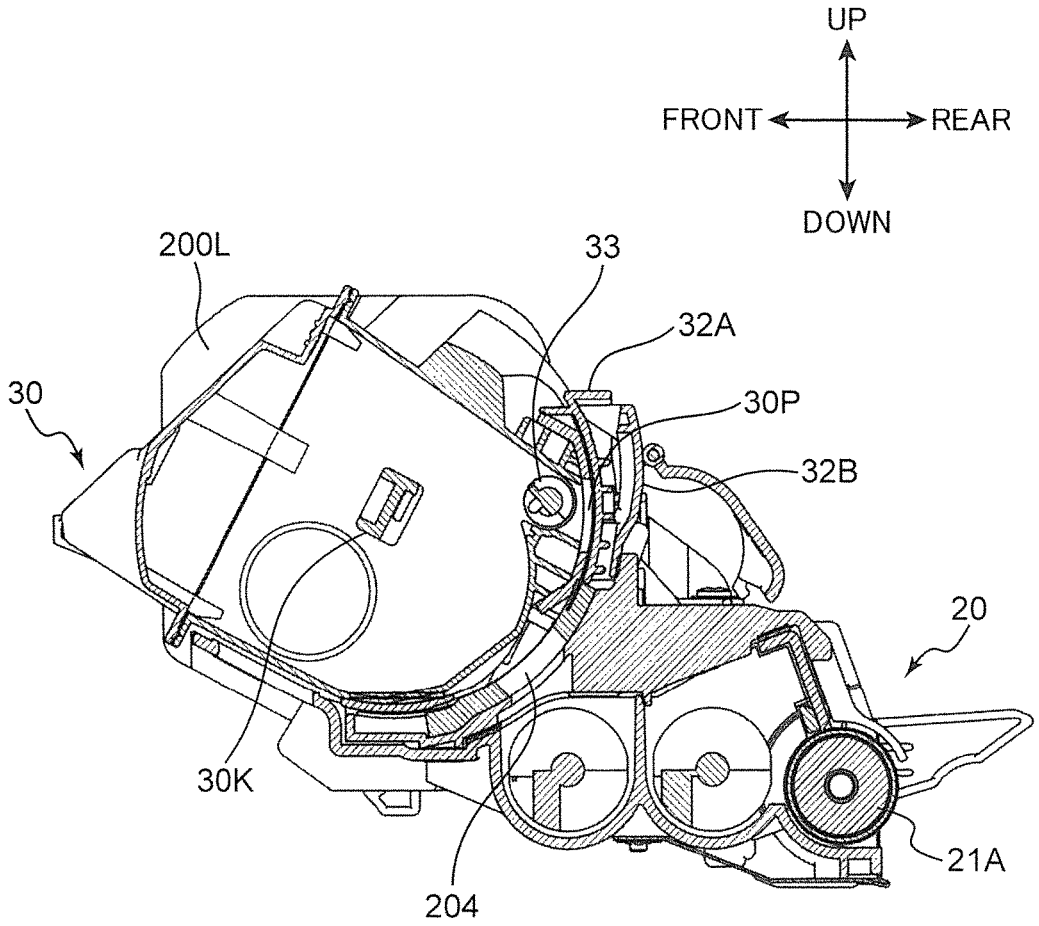
FIG. 16C is a sectional view depicting a state when the toner container is mounted to the development device.
Figure 17:
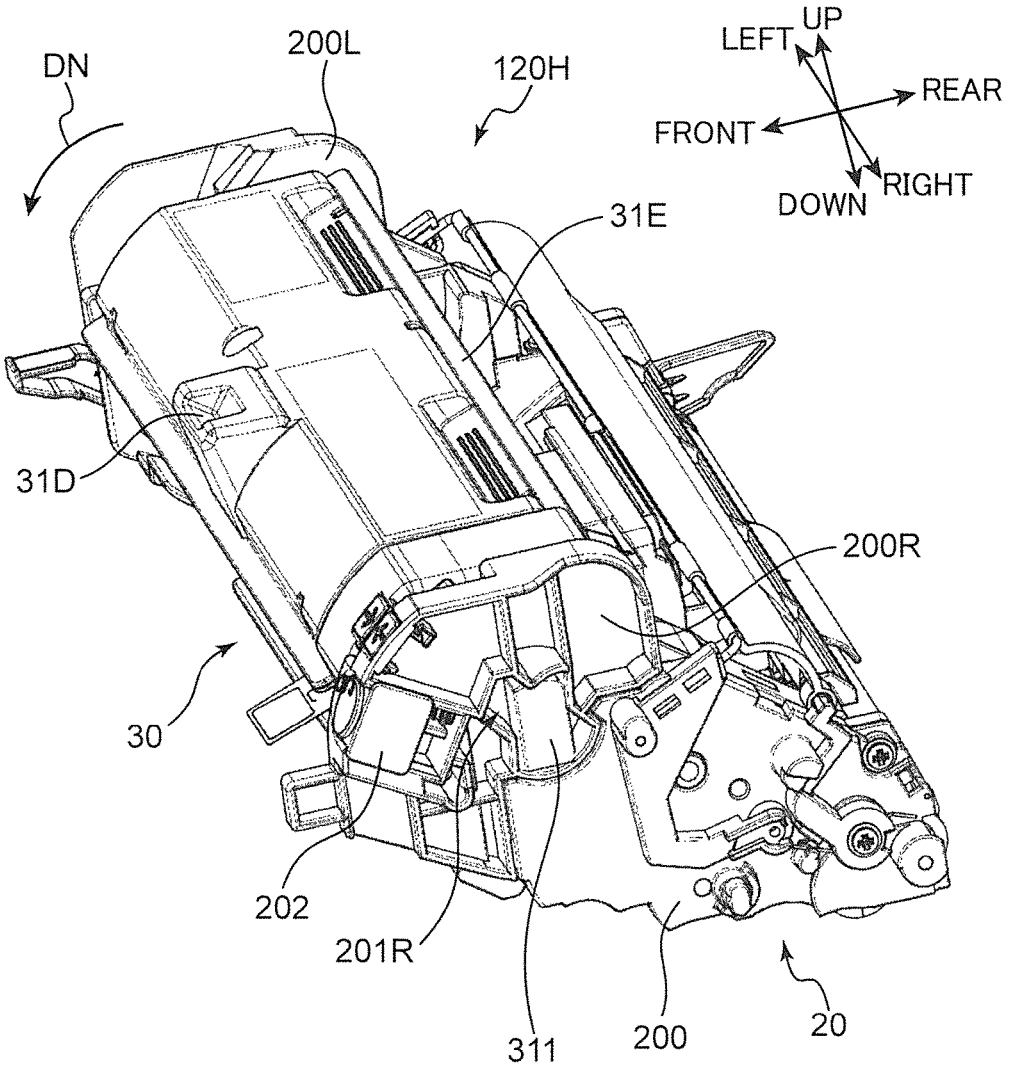
FIG. 17 is a perspective view depicting a state after the toner container is mounted to the development device.
Figure 18A:
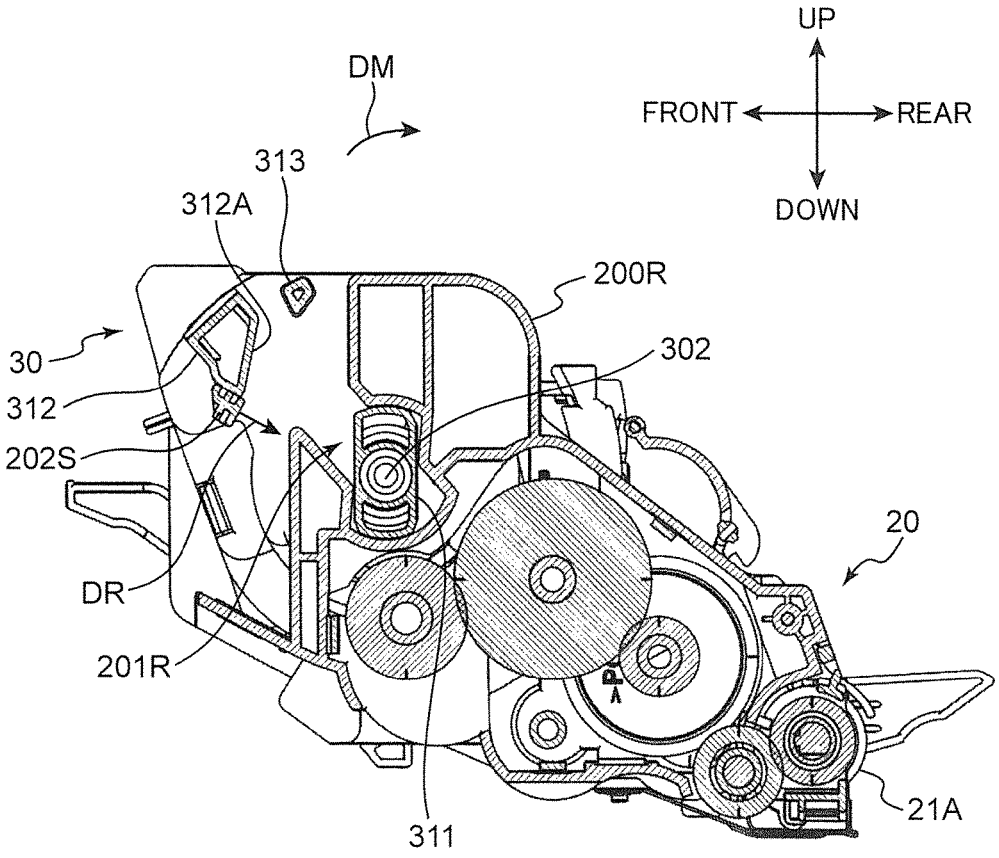
FIG. 18A is a sectional view depicting the development device in the state depicted in FIG. 17.
Figure 18B:
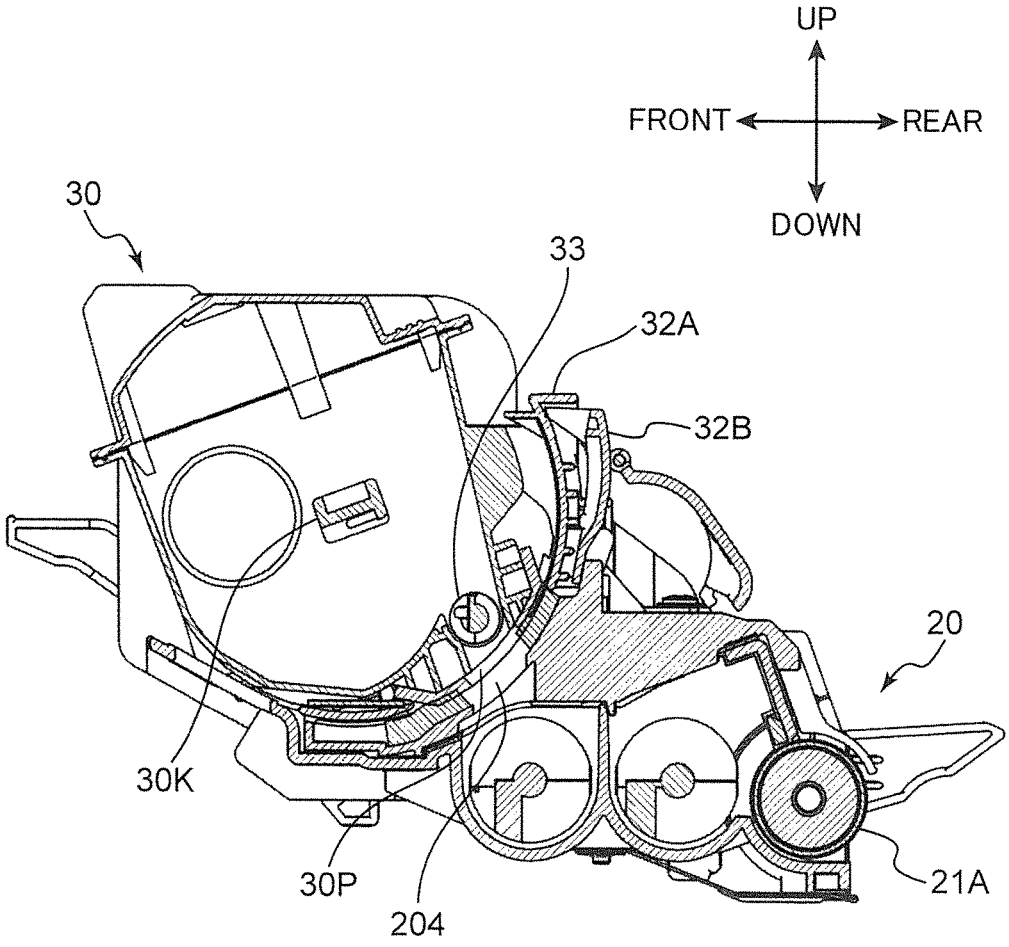
FIG. 18B is a sectional view depicting the development device in the state depicted in FIG. 17.

Next, with reference to FIGS. 13 to 18B in addition to FIGS. 12A to 12C, mounting of the toner container 30 to the development device 20 will be described. FIG. 13 is an exploded perspective view depicting the development device 20. FIGS. 14A and 14B are perspective enlarged views depicting a portion of the development device 20. FIG. 15 is a perspective view depicting a state when the toner container is mounted to the development device 20. FIGS. 16A to 16C are sectional views depicting a state when the toner container 30 is mounted to the development device 20. FIG. 17 is a perspective view depicting a state after the toner container 30 is mounted to the development device 20. FIGS. 18A and 18B are sectional views depicting the development device 30 in the state depicted in FIG. 17.

The development housing 200 of the development device 20 further includes a stopper pressing portion 206 (FIG. 12B), a container shutter fixing portion 207 (FIG. 12B), and a shutter spring 208 (FIG. 4).

The stopper pressing portion 206 is a protruding portion provided to protrude from a top wall of the development housing 200 at a position adjacent to and rearward of the toner supplementing port 204. The stopper pressing portion 206 has a function of, when the toner container 30 is mounted to the container mounting section 20H, pressing the pressing target piece 32B2 of the shutter stopper 32B of the container shutter 32.

The container shutter fixing portion 207 is composed of a pair of protruding portions provided to protrude from the top wall of the development housing 200 on both sides of the stopper pressing portion 206 in the rightward-leftward direction. In a cross-sectional view taken along a plane orthogonal to the rightward-leftward direction, the container shutter fixing portion 207 has an approximately trapezoidal shape. Further, a front sidewall of the container shutter fixing portion 207 is partially formed with a wedge-shaped cutout. During operation of mounting the toner container 30 to the container mounting section 20H, the engagement piece 32A8 of the shutter stopper 32B is engaged with the cutout. As a result, the container shutter fixing portion 207 immobilizes the container shutter 32 to restrict a rotational movement of the container shutter 32.

The shutter spring 208 is composed of a pair of spring members each disposed laterally outward of a respective one of the pair of protruding portions composing the container shutter fixing portion 207. The shutter spring 208 is disposed to extend in the forward-rearward direction. One end of the shutter spring 208 is locked to the top plate of the development housing 200. On the other hand, the other end of the shutter spring 208 is locked to a housing shutter 22 (FIG. 4). The housing shutter 22 is supported by the development housing 200 in such a manner as to be slidingly movable with respect to the toner supplementing port 204. The housing shutter 22 is operable to sealingly close or open the toner supplementing port 204.

The shutter spring 208 urges the housing shutter 22 in a direction causing the housing shutter 22 to sealingly close the toner supplementing port 204. Thus, in a state in which the toner container 30 is demounted from the development device 20 as depicted in FIG. 12A, the housing shutter 22 sealingly closes the toner supplementing port 204 under a biasing force of the shutter spring 208.

Referring to FIG. 13, the right wall 200R of the development housing 200 further includes a lock button guide groove 201S and a stopper piece 201T. The lock button guide groove 201S is formed in the right wall 200R at a position forward of the right guide groove 201R. The stopper piece 201T is composed of a part of pawls each formed to protrude into the lock button guide groove 201S at a forward position of the right wall 200R. The development device 20 further includes a lock button biasing spring 201U. The lock button biasing spring 201U is provided inside the lock button guide groove 201S to urge the lock button 202 forwardly. The locking contact piece 202S is a protrusion provided to protrude leftwardly from the lock button 202. The locking contact piece 202S has a function to lock the toner container to each of the aforementioned postures. The lock button 202 has a function of releasing the locked state of the toner container 30.

Referring to FIG. 14A, a guide opening 201V is opened in a left surface of the right wall 200R. The guide opening 201V is an elongate hole formed along a direction slightly inclined with respect to the mounting direction (the direction indicated by the arrowed line DA in FIG. 14A) of the toner container 30. The lock button 202 is inserted into the lock button guide groove 201S while compressing the lock button biasing spring 201U, and the locking contact piece 202S is fittingly inserted in the guide opening 201V. Through this operation, the lock button 202 is stopped at a position where a front end of the lock button 202 slightly protrudes from a front end of the right wall 200R under the biasing force of the lock button biasing spring 201U. Detachment of the lock button 202 is prevented by the stopper piece 201T. When a user depresses the lock button 202 against the biasing force of the lock button biasing spring 201U, the locking contact piece 202S is moved from a front end to a rear end of the guide opening 201V as depicted in FIG. 14B.

As mentioned above, in this embodiment, the toner container 30 can be mounted and demounted by itself with respect to the development device 20 in the state in which the development device 20 is first mounted to the apparatus body 101. Therefore, even in a situation where toner inside the toner container 30 has been fully consumed, the empty toner container 30 can be easily replaced with a new one. During a period before the toner container 30 is mounted to the development device 20, if the container shutter 32 is erroneously slidingly moved from a position where the container shutter 32 sealingly closes the toner discharge port 30P, toner will leak from the toner discharge port 30P. In this embodiment, when the toner container is in a stand-alone state, and the container shutter 32 is at a position where it sealingly closes the toner discharge port 30P, the shutter stopper 32B is set to the sliding movement restriction position, with respect to the shutter body 32A. Thus, the shutter stopper 32B restricts a situation where the container shutter 32 is slidingly moved from the toner discharge port 30P.

That is, when the container shutter 32 is at a position where it sealingly closes the toner discharge port 30, and the shutter stopper 32B is set to the sliding movement restriction position, the engagement piece 32B4 penetrating through the hole 32A6 is engaged with the engagement target portion 309S of the container shutter lock rib 309 of the container body 31, to thereby restrict sliding movement of the container shutter 32 with respect to the toner discharge port 30P. Further, the distal end of the elastic piece 32B5 exposed to the side of the sealing surface of the shutter body 32A from the elastic piece support portion 32A4 is disposed in opposed relation to the elastic piece pressing portion 306.

Thus, when the pressing target piece 32B2 of the shutter stopper 32B is erroneously pressed, the elastic piece 32B5 is slightly urged in a radially outward direction of the toner container 30 by the elastic piece pressing portion 306, and elastically deformed. As a result of the phenomenon that the distal end of the elastic piece 32B5 is urged and elastically deformed in this manner, an urging force is applied to the engagement piece 32B4 of the shutter stopper 32B about the pair of protruding pieces composing the pivot portion 32B3, in a direction causing the engagement piece 32B4 to be more strongly engaged with the engagement target portion 309S of the container shutter lock rib 309. Thus, when the toner container 30 is stored and transported by itself, an elastic force of the elastic piece 32B5 prevents sliding movement of the container shutter 32 along the guide rib 307. Therefore, the container shutter 32 can sealingly close the toner discharge port 30P in a stable manner.

In an open state of the front cover 106, the toner container 30 is mounted to the development device 20 inside the apparatus body 101 by a user of the image forming apparatus 100. During this operation the user can easily grip the toner container, for example, by hooking the second grip 31E (FIG. 15) located on an upper side of the toner container 30 with first to third fingers and further hooking the first grip 31D (FIG. 15) of the toner container 30 with a thumb. The user inserts the left guide 301 and the right guide 311 of the toner container 30, respectively, into the left guide groove 201L and the right guide groove 201R. Through this operation, the toner container 30 is insertingly mounted to the container mounting section 20H while being guided along the mounting direction (the direction indicated by the arrowed direction DA in FIG. 15) by the left guide groove 201L and the right guide groove 201R. Thus, the toner container 30 is insertingly mounted to the container mounting section 20H in the first posture depicted in FIGS. 15, and 16A to 16C. As mentioned above, in this first posture, the toner discharge port 30P of the toner container 30 is located away upwardly from the toner supplementing port 204 of the development device 20, so that the toner discharge port 30P has not yet communicated with the toner supplementing port 204 (FIG. 16C).

In the first posture, as depicted in FIG. 12B, the stopper pressing portion 206 of the development housing presses the pressing target piece 32B2 disposed between the pair of protruding pieces composing the pressing target piece support portion 32A2. Thus, the shutter stopper 32B is swung about the pair of shaft portions 32B31 from the sliding movement restriction position from the sliding movement permission position. Specifically, the engagement piece 32B4 is disengaged from the engagement target portion 309S of the container shutter lock rib 309, i.e., the engagement therebetween is released (FIG. 16B). As a result, the shutter stopper 32B permits sliding movement of the container shutter 32 with respect to the container body 31. In this process, axial movement of the pair of shaft portions 32B31 of the pivot portion 32B3 is restricted by the shaft displacement restriction portion 32C. This prevents the pair of shaft portions 32B31 of the shutter stopper 32B from being demounted from the pair of bearing portions composing the stopper shaft support portion 32A3 of the shutter body 32A.

Further, when the toner container 30 is mounted to the container mounting section 20H in the first posture depicted in FIG. 15, the engagement piece 32A8 is engaged with the wedge-shaped cutout of the container shutter fixing portion 207 (FIG. 12B). As a result, the container shutter 32 is fixed to the container shutter fixing portion 207. Subsequently, the user rotates the container body 31 of the toner container 30 from the first posture depicted in FIG. 15, in the first rotation direction (the direction indicated by the arrowed line DM in FIG. 15) about the axis of the container paddle 30K.

When the container body 31 is rotated in the first rotation direction with respect to the container shutter 32 fixed to the container shutter fixing portion 207, in such a manner that the posture thereof is changed from the first posture to the second posture depicted in FIGS. 17 to 18B, the toner discharge port 30P formed in the container body 31 is slidingly moved with respect to the container shutter 32. As mentioned above, in this second posture, the toner discharge port 30P of the toner container 30 communicates with the toner supplementing port 204 of the development device 20 (FIG. 18B). This makes it possible to supplenentarily supply toner from the toner container 30 to the development device 20.

During operation of rotating the container body 31 of the toner container 30 from the first posture in the first rotation direction, the elastic piece pressing portion 306 of the container body 31 which presses the distal end of the elastic piece 32B5 of the shutter stopper 32B is moved away from the elastic piece 32B5. Thus, when the toner discharge port 30P is in an open state, it is possible to prevent the elastic piece 32B5 from being continuously applied with a strong force so as to suppress plastic deformation of the elastic piece 32B5.

On the other hand, in a situation where the toner container 30 is not mounted to the container mounting section 20H, the housing shutter 22 sealingly closes the toner supplementing port 204. When the container body 31 of the toner container 30 is insertingly mounted to the container mounting section 20H and then rotated in the first rotation direction as mentioned above, so that the posture thereof is changed from the first posture to the second posture, the container shutter pressing piece 305S (FIG. 7) of the toner container 30 presses the housing shutter 22 in the first rotation direction against the biasing force of the shutter spring 208 (FIG. 4). As a result, the housing shutter 22 is slidingly moved in the first rotation direction, together with the container body 31 of the toner container 30, and therefore the toner supplementing port 204 is opened as depicted in FIG. 18B. This makes it possible to enable the toner discharge port 30P and the toner supplementing port 204 to commentate with each other in an upward-downward direction.

As depicted in FIG. 15, when the toner container 30 is insertingly mounted to the container mounting section 20H in the first posture, the locking contact piece 202S is brought into contact with the second lock engagement portion 313 as depicted in FIG. 16A. Subsequently, the user rotates the container body 31 of the rock container 30 in the first rotation direction, the locking contact piece 202S is slidingly moved on the second lock engagement portion 313 and finally moved away from the second lock engagement portion 313. Then, after slidingly moving on an inclined surface 312A of the first lock engagement portion 312, the locking contact piece 202S is engaged with the first lock engagement portion 312 at a position underneath the first lock engagement portion 312 as depicted in FIG. 18A. As a result, the toner container 30 is locked in the second posture by the locking contact piece 202S (FIG. 18B). In this locked state, even when the biasing force of the shutter spring 208 (FIG. 4) is applied to the container shutter pressing portion 305 of the toner container 30 via the housing shutter 22, a rotational movement of the toner container 30 is restricted by the locking contact piece 202S. This makes it possible to prevent a rotational movement of the toner container 30 toward the second rotation direction, i.e., a postural change of the toner container 30 from the second posture to the first posture.

When a non-depicted sensor detect that toner inside the toner container 30 has been fully consumed, information indicative of replacement of the toner container 30 is displayed on a non-depicted display of the printer 100. When the user depresses the lock button 202, the locking contact piece 202S is moved rearwardly along the guide opening 201V (FIG. 14B). As a result, as indicated by the arrowed line DR in FIG. 18A, the locking contact piece 202S is moved away rearwardly from the first lock engagement portion 312, and the engagement between the locking contact piece 202S and the first lock engagement portion 312 is released. Therefore, a restriction force for restricting the first lock engagement portion 312 is lost and the locked state of the toner container 30 is released. The biasing force of the shutter spring 208 is applied to the housing shutter 22. Thus, the container body 31 of the toner container 30 is rotated in the second rotation direction (indicated by the arrowed line DN in FIG. 17) while the housing shutter 22 presses the container shutter pressing portion 305 of the toner container 30. As a result, the container body 31 of the toner container 30 is automatically changed in posture from the second posture to the first posture by the biasing force of the shutter spring 208.

During operation of rotating the container body 31 of the toner container 30 in the second rotation direction, the locking contact piece 202S is urged against the inclined surface 312A of the first lock engagement portion 312 by the biasing force of the lock button biasing spring 201U. When the first lock engagement portion 312 is moved away from the locking contact piece 202S, the locking contact piece 202S is returned to the position depicted in FIG. 14.

When the container body 31 is rotated in the second rotation direction with respect to the container shutter 32 fixed to the container shutter fixing portion 207, so that the posture thereof is changed from the second position to the first position, the toner discharge port 30P formed in the container body 31 is slidingly moved with respect to the container shutter 32. Therefore, the toner discharge port 30P is sealingly closed by the container shutter 32 again. Further, the housing shutter 22 is slidingly moved by the biasing force of the shutter spring 208, so that the toner supplementing port 204 is sealingly closed by the housing shutter 22 again.

By demounting the toner container 30 set in the first posture depicted in FIG. 15 from the container mounting section 20H again along a direction opposite to the mounting direction, the toner container is detached from the image forming apparatus 20. As above, in this embodiment, a user can release the lock state of the toner container 30 simply by depressing the lock button 202, and then change the posture of the container body 31 of the toner container 30 to the first posture. During this operation, the toner discharge port 30P and the toner supplementing port 204 are sealingly closed, respectively, by the container shutter 32 and the housing shutter 22. This makes it possible to prevent surroundings of the toner container 30 from being contaminated by toner when a user detaches the toner container 30.

The present disclosure described as above can provide a developer storage container capable of improving stability in sealingly closing and opening of a shutter with respect to a developer discharge port, and an image forming apparatus equipped with the developer storage container.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developer storage container demountably mounted to a development device, comprising:

a container body which stores developer thereinside and has a developer discharge port for discharging the developer toward the development device therethrough, the container body being capable of being changed in posture between a first posture to be mounted to the development device, and a second posture to be rotated from the first posture in given one direction; and a shutter supported by the container body in such a manner as to be slidingly movable with respect to the developer discharge port in response to the postural change to thereby sealingly close or open the developer discharge port, wherein the shutter includes:

a shutter body having a sealing surface for sealingly closing the developer discharge port, and a pair of bearing portions provided on a back surface thereof on a side opposite to the sealing surface;

a swingable member having a pair of shaft portions each pivotally supported by a respective one of the pair of bearing portions, the swingable member being mounted to the back surface of the shutter body in such a manner as to be swingable about the shaft portions and between a sliding movement restriction position where the swingable member restricts the sliding movement of the shutter, and a sliding movement permission position where the swingable member permits the sliding movement of the shutter; and a shaft displacement restriction portion which restricts an axial movement of the pair of shaft portions of the swingable member.

2. The developer storage container as recited in claim 1, wherein the shaft displacement restriction portion includes:

a pair of first shaft displacement restriction protruding pieces each protrudingly provided on the back surface of the shutter body in opposed relation to a respective one of the pair of bearing portions; and a pair of second shaft displacement restriction protruding pieces each protruding from a respective one of the pair of shaft portions of the swingable member and each sandwiched between corresponding ones of the pair of bearing portions and the pair of first shaft displacement restriction protruding pieces.

3. The developer storage container as recited in claim 1, wherein:

the container body includes an engagement target portion provided adjacent to the developer discharge port; and the swingable member includes an engagement piece which is engageable with the engagement target portion at the sliding movement restriction position, and releasable from the engagement with the engagement target portion at the sliding movement permission position.

4. The developer storage container as recited in claim 3, wherein the swingable member includes a pressing target piece which is disposed on a side opposite to the engagement target portion with respect to the pair of shaft portions and to which a pressing force is applicable from the development device, and wherein the swingable member is swingable from the sliding movement restriction position to the sliding movement permission position by applying a pressing force to the pressing target piece.

5. An image forming apparatus comprising:

an image carrier having a surface on which an electrostatic latent image is to be formed and a developer image is to be carried;

a development device which supplies developer to the image carrier; and the developer storage container as recited in claim 1, the developer storage container being mounted to the development device so as to supplementarily supply developer to the development device.

* * * * *